United States Patent [19]

Abe et al.

[11] Patent Number: 5,063,131

[45] Date of Patent: Nov. 5, 1991

[54] METHOD FOR PROCESSING SILVER HALIDE PHOTOGRAPHIC PHOTOSENSITIVE MATERIALS

[75] Inventors: Akira Abe; Yoshihiro Fujita; Keiji Mihayashi, all of Minami-Ashigara, Japan

[73] Assignee: Fuji Photo Film Co., Ltd., Minami, Japan

[21] Appl. No.: 541,470

[22] Filed: Jun. 22, 1990

Related U.S. Application Data

[63] Continuation of Ser. No. 154,593, Feb. 10, 1988, abandoned.

[30] Foreign Application Priority Data

Feb. 13, 1987 [JP] Japan ..... 62-31092

[51] Int. Cl.[5] ..... G03C 5/39; G03C 7/40

[52] U.S. Cl. ..... 430/372; 430/398; 430/421; 430/428; 430/429

[58] Field of Search ..... 430/351, 372, 393, 398, 430/399, 421, 463, 470, 428, 429, 490, 551

[56] References Cited

U.S. PATENT DOCUMENTS

| | | | |
|---|---|---|---|
| 2,701,197 | 2/1955 | Thirtle et al. | 430/607 |
| 4,189,239 | 4/1980 | Credner et al. | 430/551 |
| 4,336,324 | 6/1982 | Koboshi et al. | 430/421 |
| 4,430,425 | 2/1984 | Leppard | 430/551 |
| 4,530,899 | 7/1985 | Ohki et al. | 430/372 |
| 4,584,263 | 4/1986 | Takahashi | 430/372 |
| 4,584,264 | 4/1986 | Ohki et al. | 430/542 |
| 4,587,210 | 5/1986 | Ono et al. | 430/551 |
| 4,751,556 | 6/1988 | Kishimoto | 430/556 |
| 4,764,453 | 8/1988 | Koboshi et al. | 430/372 |

FOREIGN PATENT DOCUMENTS 0168263 1/1986 European Pat. Off. .

*Primary Examiner*—Hoa Van Le

*Attorney, Agent, or Firm*—Burns, Doane, Swecker & Mathis

[57] ABSTRACT

A method for processing a silver halide color photographic photosensitive material comprises treating a silver halide photographic material with a bath having fixing ability and then washing with water and/or stabilizing the photosensitive material and characterized in that the amount of replenisher for water washing or stabilization is controlled so that it is 1 to 50 times the volume of liquid carried over by the photosensitive material processed from the bath preceding the water washing bath or the stabilization bath and that the photosensitive material comprises, for instance, compounds (13):

The method makes it possible to substantially keep the image performance of the photosensitive material processed high while substantially saving the amount of washing water or the stabilization liquid and substantially shortening the water washing or the stabilization time.

18 Claims, No Drawings

METHOD FOR PROCESSING SILVER HALIDE PHOTOGRAPHIC PHOTOSENSITIVE MATERIALS

This application is a continuation of application Ser. No. 154,593, filed Feb. 10, 1988, now abandoned.

BACKGROUND OF THE INVENTION

1. Field of the Invention

The present invention relates to a method for processing silver halide color photographic photosensitive materials and in particular to a method for processing silver halide color photographic materials, which provides a high quality image, even if the image is obtained by subjecting the materials to the processing in which the amount of washing water is substantially saved.

2. Description of the Prior Art

Recently, it has been proposed to reduce the amount of washing water used in water washing and other processes for processing silver halide photographic photosensitive materials, in view of environmental protection, exhaustion of water resources and enhanced economy. For example, one of the techniques for reducing the amount of washing water is proposed by S. R. Goldwasser in his article entitled "Water Flow Rates in Immersion-Washing of Motion Picture Film", Journal of the Society of Motion Picture and Television Engineers, 1955, Vol. 64, pp. 248–253 in which the saving of an amount of washing water is achieved by employing a multistage washing system including the use of a plurality of washing tanks and countercurrently passing water therethrough. Likewise, U.S. Pat. No. 4,336,324 discloses another method comprising directly transferring bleached and fixed photosensitive materials to stabilization process without substantially passing them through a washing process to save the amount of washing water. These methods have been adopted in different kinds of automatic processors as an effective tool for water-saving.

However, the substantial saving of washing water without implementing any other means leads to an increase in the amount of components of a processing liquid which remain in the color photosensitive materials processed. This entrains various kinds of problems such as the discoloration of color images, the increase in stain, the oozing out, to the surface of the photosensitive materials, of high-boiling point organic solvents included in the materials (hereunder referred to as "sweating out phenomenon"), which greatly impairs the image stability. In addition to the aforementioned problems, there is another problem that the turbidity of a water washing bath or a stabilization bath is increased due to the proliferation of various bacteria and/or mold. These problems associated with these water-saving methods are increased as the water washing time is reduced. Therefore, the simultaneous achievement of the requirements, i.e., the reduction of water washing time and the water-saving, in this field has been considered difficult.

As a means of solving the foregoing problems, S. R. Goldwasser has proposed, in his article, a method in which the photosensitive materials are countercurrently washed in a system employing more increased number of washing baths. However, the number of water washing baths is limited to 2 to 4 do to the limited area to be assigned to such equipments and the processing cost.

Therefore, the desired water-saving has not yet been achieved established.

As another method for eliminating the foregoing drawbacks, Japanese Patent Un-examined Published Application (hereinafter referred to as "J.P. KOKAI") No. 62-92947 proposes the addition of a sodium or potassium salt of a chelating agent to the washing water for the purpose of preventing the occurrence of the discoloration. This method is surely effective for that purpose, however, a large excess thereof should be added thereto in order to prevent the discoloration while substantially saving the amount of water. But, this inversely affects the photosensitive materials and results in the formation of drying marks and makes the photosensitive layer sticky. Further, J.P. KOKAI No. 59-184345 discloses a stabilization bath to which an ammonium compound is added. The effect attained by this method is insufficient and a remarkable discoloration of cyan dyes is probably caused dependent upon conditions. In addition, J.P. KOKAI No. 61-43741 discloses a stabilization liquid having a controlled surface tension, however, the effect thereof has not clearly been recognized. Moreover, there has not yet been established a means for solving the problem of the foregoing sweating out phenomenon.

As discussed above in detail, there has not yet been established a practical means for eliminating the foregoing drawbacks such as the discoloration of dyes, the occurrence of stains and the sweating out phenomenon associated with the water saving in processing of the color photographic materials. Therefore, there has been a strong demand for the development of a new technique therefor.

SUMMARY OF THE INVENTION

Accordingly, it is a primary purpose of the present invention to provide a method for processing silver halide photographic photosensitive materials, which does not impair the image stability even when the amount of washing water is substantially reduced.

It is another purpose of the present invention to provide a method for processing silver halide photographic photosensitive materials, which makes it possible to reduce the amount of washing water and simultaneously to substantially shorten the time required for water washing.

It is a further purpose of the present invention to provide a method for processing silver halide photographic photosensitive materials, which makes it possible to reduce the amount of washing water without causing the formation of drying marks and without making the materials sticky during and after the processing thereof.

The aforementioned purposes of the present invention can effectively be attained by providing a method comprises treating a silver halide photographic photosensitive material with a bath having fixing ability and then washing with water or stabilizing the photosensitive material and wherein the amount of replenishing liquid for water washing or stabilization is controlled so that it is 1 to 50 times the volume of liquid carried over by the photosensitive material from the bath preceding the water washing bath or the stabilization bath and that the silver halide color photographic photosensitive material comprises at least one member selected from the group consisting of compounds represented by the following general formula (A) and alkaline unstable precursors thereof:

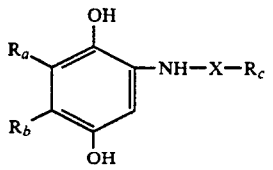

in the general formula (A), $R_a$ and $R_b$ each represents hydrogen atom, halogen atom, sulfo group, carboxyl group, alkyl group, acylamino group, alkoxy group, aryloxy group, alkylthio group, arylthio group, sulfonyl group, acyl group, carbamoyl group or sulfamoyl group with the proviso that $R_a$ and $R_b$ may form a carbon ring together with the carbon atoms to which they are bonded; X represents —CO— or —$SO_2$—; and $R_c$ represents alkyl group, aryl group, heterocyclic group, cycloalkyl group, alkoxy group, aryloxy group or amino group; provided that the total number of carbon atoms of $R_a$, $R_b$ and $R_c$ is not less than 10. Compounds (A) are substantially colorless and never cause a coupling reaction with the developing agent to form a dye image.

DETAILED EXPLANATION OF THE INVENTION

Compounds (A) will hereunder be explained in detail.

In the general formula (A), $R_a$ and $R_b$ each represents hydrogen atom; halogen atom such as chlorine or bromine; sulfo group; carboxyl group; alkyl group such as methyl, pentadecyl or tert-hexyl group; acylamino group such as acetylamino or benzoylamino group; alkoxy group such as methoxy or butoxy group; aryloxy group such as phenoxy group; alkylthio group such as octylthio or hexadecylthio group; arylthio group such as phenylthio group; sulfonyl group such as dodecanesulfonyl or p-toluenesulfonyl group; acyl group such as acetyl or benzoyl group; carbamoyl group such as N,N-dibutylcarbamoyl group; or sulfamoyl group such as N,N-diethylsulfamoyl group and further $R_a$ and $R_b$ may form a carbon ring together with the carbon atoms to which they are bonded. X represents —CO— or —$SO_2$—. $R_c$ represents alkyl group such as heptadecyl, 1-hexylnonyl or 1-(2,4-ditert-aminophenoxy)-propyl group; aryl group such as phenyl, 3,5-bis (2-hexyldecaneamido)-phenyl, 3,4-bis(hexadecyloxycarbonyl)-phenyl or 2,4-bis(tetradecyloxy)-phenyl group; heterocyclic group such as 2,6-dihexyloxypyridin-4-yl, N-tetradecylpyrrolidin-2-yl or N-octadecylpiperidin-3-yl group; cycloalkyl group such as 3-decaneamidocyclohexyl or 3-((2,4-di-tert-amylphenoxy)butaneamido)-cyclohexyl group; alkoxy group such as hexadecyloxy group; aryloxy group such as 4-tertoctylphenoxy group; or amino group such as octadecyamino group. In this connection, the total number of carbon atoms of $R_a$, $R_b$ and $R_c$ should be not less than 10, preferably 10 to 50.

Compounds (A) may be in the form of a dimer, a trimer or a higher polymer.

In the general formula (A), $R_a$ and $R_b$ each preferably represents hydrogen atom, halogen atom, alkyl group, alkoxy group or alkylthio group, more preferably hydrogen atom, halogen atom or alkyl group having $C_{1-20}$ among others and most preferably represents hydrogen atom.

In the general formula (A), X is preferably —CO—.

Preferred $R_c$ in the general formula (A) is alkyl group or aryl group and the most preferred is aryl group having $C_{1-40}$ among these.

If $R_c$ in the general formula (A) represents aryl group, such an aryl group may be substituted with substituents which must not be limited to a specific ones so far as they are known as the substituents for aryl rings. Examples of preferred substituents include halogen atom, alkyl group, amido group, sulfonamido group, alkoxy group, alkoxycarbonyl group and carbamoyl group. In this respect, the substituents for aryl groups should not have any sulfo and/or carboxyl groups because the presence of such water-soluble groups may exerts a harmful influence on the storability of the color photosensitive materials.

Since the compounds as used herein are added to the silver halide color photographic photosensitive materials for the purpose of preventing the discoloration of dyes and the formation of stains observed when the amount of washing water is substantially saved, it is not desirable that the compounds per se be colored or that they form a color image during the developing process.

Therefore, first of all, the compounds used in the present invention should be substantially colorless. The term "substantially colorless" herein means that the compound absorbs visible light ranging from 400 to 700 nm to the extent that the molar absorption coefficient is not more than 5,000. Secondary, the compound as used herein should not have a coupler residue such as acylacetoanilide residue, 5-pyrazolone residue or 1-naphthol residue, which is known to cause a coupling reaction with the oxdized form of a color developing agent to form a color image and thus it does not form a color image due to such a coupling reaction during the developing process.

The alkaline unstable precursors of the compounds represented by the general formula (A) are those represented by the general formula (A) in which the hydroxyl moiety situating at 1- and 4-positions of the hydroquinone skeleton thereof is protected with protective groups capable of being eliminated under an alkaline condition.

Typical examples of such protective groups include acyl group such as acetyl group, chloroacetyl group, benzoyl group or ethoxycarbonyl group; a group eliminable at betaposition through coupling (with the oxidized product of anaromatic primary amine color developing agent) as 2-cyanoethyl group, 2-methanesulfonylethyl group or 2-toluenesulfonylethyl group.

These compounds represented by the general formula (A) and the alkaline unstable precursors thereof may easily be synthesized according to any methods such as those disclosed in U.S. Pat. No. 2,701,197; Japanese Patent Publication for Opposition Purpose (hereinafter referred to as "J.P. KOKOKU") No. 59-37497 and J.P. KOKAI No. 59-202465.

Specific examples of such compounds represented by the general formula (A) and the alkaline unstable precursors thereof will hereunder be listed, however, it should be appreciated that it is not intended to restrict the scope of the present invention to those specific examples.

(1)
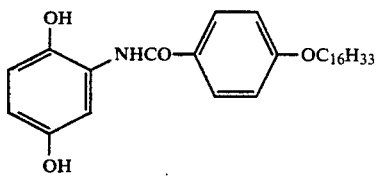
(2)
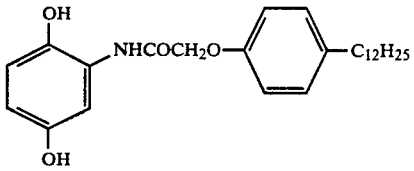
(3)
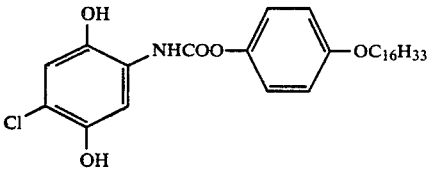
(4)
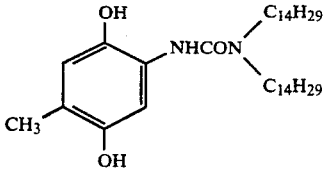
(5)
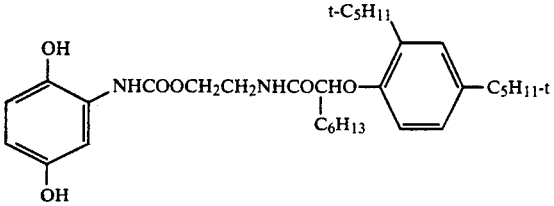
(6)
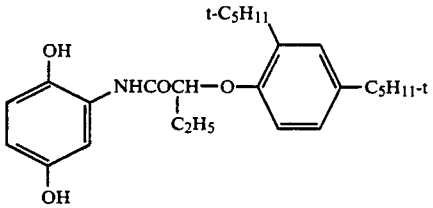
(7)
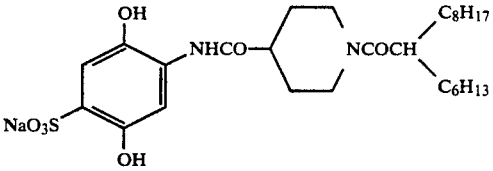
(8)
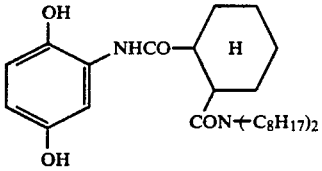

-continued
(9)
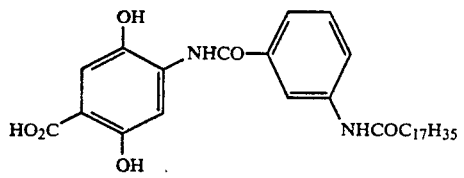
(10)
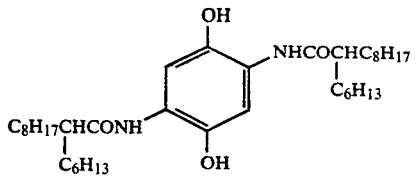
(11)
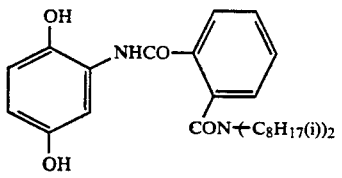
(12)
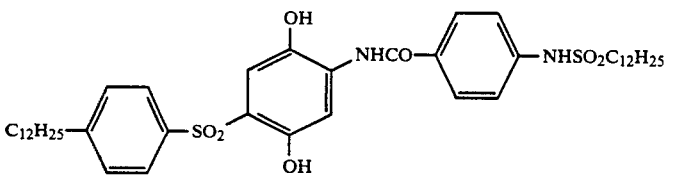
(13)
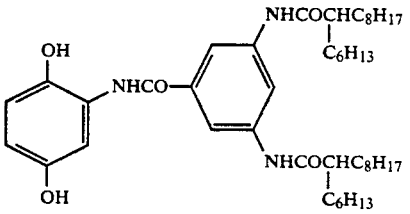
(14)
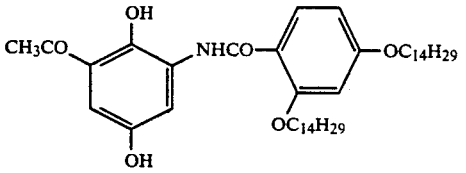
(15)
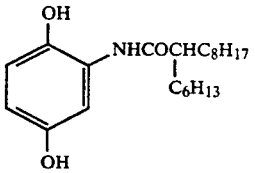
(16)
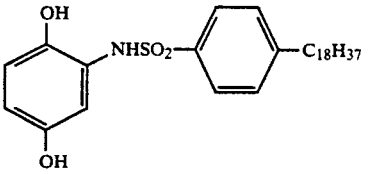

-continued
(17)
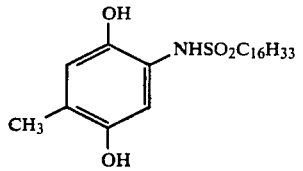
(18)
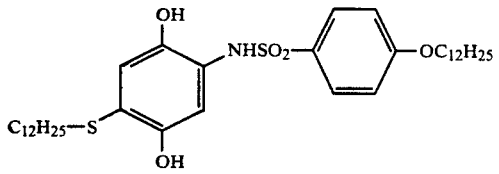
(19)
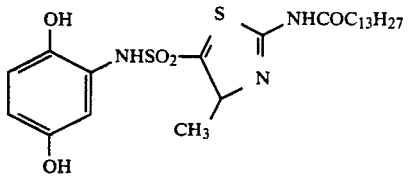
(20)
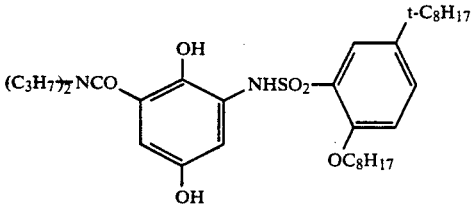
(21)
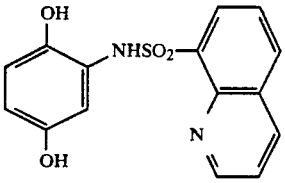
(22)
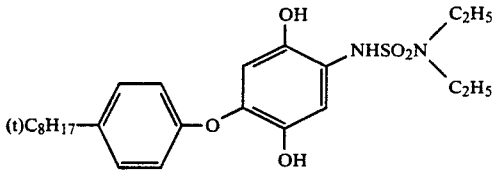
(23)
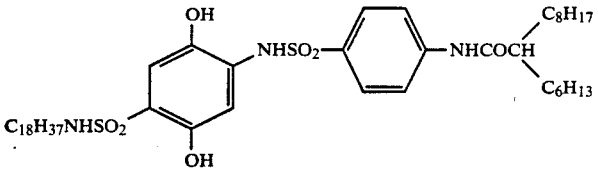
(24)
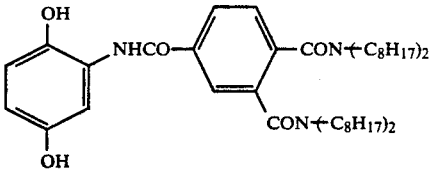

-continued (25)

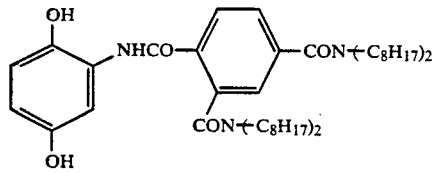

(26)

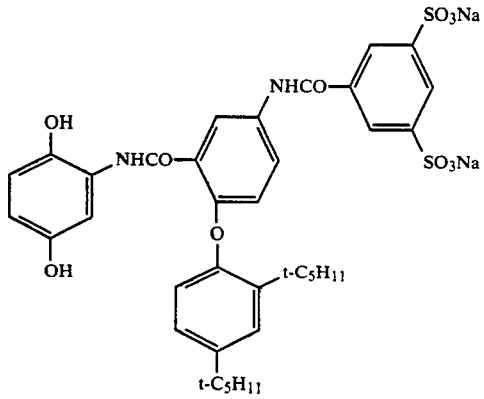

(27)

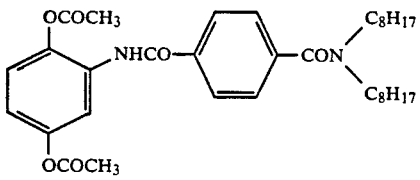

(28)

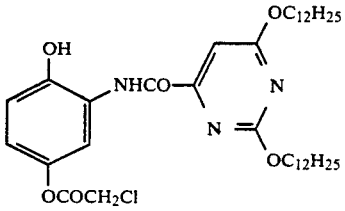

(29)

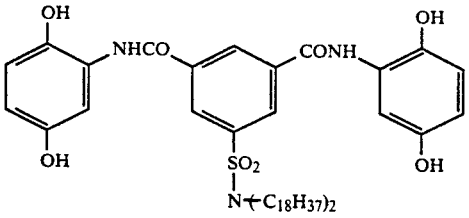

(30)

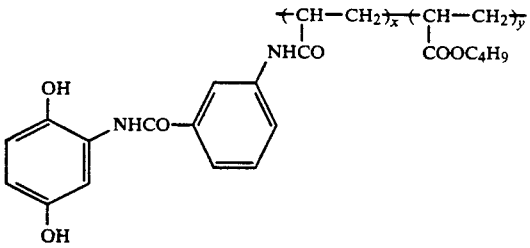

x:y = 1:2 (molar ratio)
average molecular weight = 20,000

In the present invention, the compounds represented by the general formula (A) and the alkaline unstable precursors thereof may be incorporated into any layers constituting the photosensitive material. However, it is preferred to add the same to any non-photosensitive layers. The non-photosensitive layer is more preferably an intermediate layer locating between two neighboring silver halide emulsion layers having different sensitivities to color.

The compounds represented by the general formula (A) and/or the alkaline unstable precurdors thereof may be incorporated into the photosensitive materials according to the same method as that for adding and dispersing a coupler to the photosensitive material as will be explained below.

The total amount of these compounds to be incorporated into the photosensitive materials ranges from 0.003 to 2.0 g/m$^2$ of the photosensitive layer (dry basis), preferably from 0.005 to 1.0 g/m$^2$ and more preferably 0.02 to 0.3 g/m$^2$.

The term "water washing (process)" herein means the process for making sure of the desired properties of the processed color photosensitive materials by washing out the components of the treating liquid (or solution) which are attached to or absorbed by the color photosensitive material and the ingredients of the photosensitive materials which become useless during the treatment.

On the other hand, the term "stabilization (process)" herein means the process for enhancing the storability of images to a level which is not attainable by simply carrying out the aforementioned water washing process and comprises a solution containing components having an image-stabilization effect.

The term "the amount of liquid (or solution) carried over" herein used is defined as the volume of the liquid which is attached to or absorbed and carried over by the processed photosensitive material from the preceding bath to the water washing or the stabilization process and may be determined, for instance, in accordance with the following method:

Method for Determining the Amount Carried Over

A sample of 1 m long is collected just before the color photosensitive material, during treating, entered into a water washing bath or a stabilization bath and immediately thereafter the sample is immersed in 1 liter of distilled water followed by maintaining it at 30° C. while stirring with a magnetic stirrer for 10 minutes. Then, a volume of the liquid is took therefrom, quantitatively analized on the concentration of thiosulfate ions $C_1$ (g/l) contained therein, at the same time the concentration of thiosulfate ions $C_2$ (g/l) of the fixing liquid in the preceding bath is also quantitatively determined and thus the amount of liquid A (ml) carried over from the preceding bath is estimated according to the following relation:

$$C_1 \times \frac{(1000 + A)}{A} = C_2$$

In this connection, the quantitative determination of the thiosulfate ions is effected according to acidic iodine titration after adding formaldehyde to the sample in order to mask the coexisting sulfite ions.

The water washing process and the stabilization process in the present invention will now be discussed in more detail. The amount of treating liquid to be replenished in the water washing process or the stabilization process is in the range of from 1 to 50 times the volume of the liquid carried over by the photosensitive material treated from the preceding bath, preferably 3 to 30 times the volume thereof and more preferably 5 to 20 times. The washing water or the stabilization solution may be replenished either continuously or intermittently during processing. When the replenishment is conducted intermittently, the prescribed amount of the washing water or the stabilization solution may be added to the water washing bath or the stabilization bath at intervals of about 1 m$^2$ or less, preferably 0.001 to 0.5 m$^2$ of the photosensitive material processed. Further, in the case where the amount of the photosensitive material processed is small, the prescribed amount of the washing water or the stabilization solution may be replenished after the completion of the process. It is desirable that these water washing process or the stabilization process be conducted by using 2 or more baths, preferably 2 to 6 baths and more preferably 2 to 4 baths.

When the treating liquid is replenished in such an amount falling within the range defined above, bacteria and/or mold are proliferated in the water washing baths or the stabilization baths. However, such a problem can preferably be solved by removing calcium and magnesium components contained in the replenishers and/or the washing water or the stabilization liquid, or further by adding, to the replenishers and/or the washing water or the stabilization liquid, at least one antibacterial agent or antifungus agent or mold controlling agent such as those disclosed in J. Antibact. Antifung. Agents, 1983, Vol. 11, No. 5, pp. 207–223 and "BOKIN BOBAI NO KAGAKU (CHEMISTRY FOR CONTROLLING BACTERIA AND MOLD)" by Hiroshi HORIGUCHI.

Examples of such antibacterial agents and antifungus agents include such an isothiazolone type antibacterial agent as 5-chloro-2-methyl-4-isothiazolin-3-one or 2-methyl-4-isothiazolin-3-one; a benzoisothiazolone type antibacterial agent such as those represented by 1,2-benzothizolin-3-one; a triazole derivative such as benzotriazole; a sulfamide type antibacterial agent such as sulfanylamide; an active-halogen releasing compound such as sodium hypochlorite or sodium dichloroisocyanurate; a phenol type antifungus agent such as o-phenylphenol; and an organic arsenic type antifungus agent such as 10,10'-oxybisphenoxy arsine.

Moreover, it may also be possible to add, as the softener of hard water, an aminopolycarboxylic acid such as ethylenediaminetetraacetic acid, diethylenetriaminepentaacetic acid or cyclohexanediaminetetraacetic acid; a phosphonic acid or an aminophosphonic acid such as 1-hydroxyethylidene-1,1-diphosphonic acid or ethylenediaminetetramethylene phosphonic acid. These chelating agents are preferably used in the form of a sodium salt or a potassium salt.

It is particularly desirable that the concentration of calcium or magnesium contained in the washing water or the stabilization liquid (inclusive of the replenishers therefor) be restricted to not more than 5 mg/l on the basis of the calcium and magnesium and more preferably not more than 3 mg/l. Such a control of the content of calcium and magnesium makes it possible to substantially suppress the proliferation of bacteria and/or mold in the washing water and the stabilization liquid (or baths therefor).

The control of the amount of calcium and magnesium in the washing water or the stabilization liquid inclusive of the replenishers therefor may be effected in accordance with a variety of known methods. However, it is preferable to use an ion exchange resin or a device for reverse osmosis.

Examples of ion exchange resins to be used herein include various kinds of cation exchange resins and preferably Na-type cation exchange resins which exchange Ca and Mg ions with Na ions.

Moreover, H-type ion exchange resins may also be used in the method of the present invention, however, it is preferable, in this case, to use the same together with an OH-type anion exchange resin. This is because pH of the treating water falls within the acidic region when an H-type cation exchange resin is employed alone.

In this respect, preferred ion exchange resins are strong acidic cation exchange resins which are mainly composed of styrene-divinylbenzene copolymer and have sulfonic groups as the ion exchange group. Examples of such ion exchange resins include Diaion SK-1B or Diaion PK-216 (manufactured and sold by MITSUBISHI CHEMICAL INDUSTRIES LTD.). The basic copolymer of these ion exchange resins preferably comprises 4 to 16% by weight of divinylbenzene on the basis of the total charge weight of monomers at the time of preparation. Moreover, preferred examples of anion exchange resins which may be used in combination with H-type cation exchange resins are strong basic anion exchange resins which mainly comprise styrene-divinylbenzene copolymer and have tertiary or quaternary ammonium groups as the ion exchange group. Specific examples thereof include Diaion SA-10A or Diaion PA-418 (also, manufactured and sold by MITSUBISHI CHEMICAL INDUSTRIES LTD.).

As to the apparatus for reverse osmosis herein used, any known ones may be used in the method of this invention without any restriction. However, it is desirable in the present invention to use a highly miniaturized apparatus for reverse osmosis having 3 $m^2$ or less, preferably 2 $m^2$ or less of a reverse osmosis membrane and to conduct under a pressure of 30kg/$cm^2$ or less, preferably 20kg/$cm^2$ or less. The use of such a highly miniaturized apparatus results in good workability and sufficient water-saving effect. In addition, washing water and stabilization liquid (including the replenishers therefor) to be treated may be passed through a layer of active carbon or a magnetic field.

The membrane for reverse osmosis fitted to the apparatus therefor includes, for instance, membrane of cellulose acetate, membrane of ethyl cellulose-polyacrylic acid, membrane of polyacrylonitrile, membrane of polyvinylene carbonate and membrane of polyether sulfone.

The pressure for passing liquid through the membrane usually falls within the range of from 5 to 60 kg/$cm^2$. However, it is sufficient to use the pressure of not more than 30 kg/$cm^2$ in order to achieve the purposes of the present invention and a so-called low-pressure reverse osmosis apparatus driven at a pressure of 10 kg/$cm^2$ or less may also be used in the invention effectively.

The structure of the membrane for reverse osmosis may be spiral, tubular, hollow fiber, pleated or rod type one.

Furthermore, it is preferred to irradiate, with ultraviolet rays, the liquid included in at least one bath selected from water washing baths and stabilization baths inclusive of auxiliary tanks therefor, which permit the more effective suppression of proliferation of mold.

The source of ultraviolet light as used herein may be an ultraviolet lamp such as a low pressure mercury vapour discharge tube which emits line spectrum of 253.7 nm in wavelength. In the present invention, preferred are those having a power of bactericidal ray ranging from 0.5 W to 7.5 W, among others.

The ultraviolet lamp may be disposed either outside or inside the liquid to be irradiated.

In the stabilization liquid, there are used compounds having image stabilization effect in addition to those used in the water washing process. Typical examples thereof include such an aldehyde compound as formaldehyde (formalin) or glutaraldehyde. In this respect, it is not necessary to add such an aldehyde compound as formalin to the stabilization liquid when the color photosensitive materials include a 2-equivalent magenta coupler.

In addition to the aforementioned compounds, the stabilization liquid may include other various compounds, for instance, a variety of buffering agents for adjusting pH of the processed film of photosensitive material, such as borates, metaborates, borax, phosphates, carbonates, potassium hydroxide, sodium hydroxide, aqueous ammonia, monocarboxylic acids, dicarboxylic acids and polycarboxylic acids which are used in a proper combination. Moreover, there may be added thereto a fluorescent brightener according to individual applications and a variety of ammonium salts such as ammonium chloride, ammonium sulfite, ammonium sulfate and ammonium thiosulfate.

The pH value of the washing water or the stabilization liquid usually ranges from 4 to 9 and preferably 5 to 8. However, the stabilization liquid may sometimes be used in an acidic condition (pH of not more than 4) by the addition of an acid such as acetic acid according to the applications and purposes.

The time required for the water washing or the stabilization process will now be explained hereinafter.

In the method according to the present invention, the water washing process or the stabilization process is in general effected for 10 seconds to 10 minutes. However, in view of quick treatment, it is preferred to shorten the time required for these treatments as short as possible, more specifically to reduce the time to 20 seconds to 4 minutes, in particular to 20 seconds to 2 minutes. It has conventionally been recognized that the shorter the time for water washing or stabilization, the higher the degree of the discoloration and the possibility of causing stains. In this respect, the method of this invention would be effective, in particular, in such a case in which these processes are carried out within a short period of time.

It is preferable to carry out the water washing process or the stabilization process in combination with various means for promoting the washing effect. Examples of such a means which may be used in the present invention include a means for generating ultrasonics in the liquid, a means for air bubbling, a means for applying a jet stream to the surface of the photosensitive materials and a pair of rollers for compressing the photosensitive material processed.

The water washing process or the stabilization process may be effected at a temperature ranging from 20° to 50° C., preferably 25° to 45° C. and more preferably 30° to 40° C.

Further, the overflow liquid from the water washing process or the stabilization process, associated with the replenishment of the replenisher therefor may be introduced into a bath of the preceding process. This makes it possible to properly maintain a desired concentration of the liquid for the preceding process by simply adding a more concentrated replenisher therefor to the bath in a small amount and as a result, the amount of waste liquor therefrom can substantially be reduced. The method of this invention exhibits an excellent effect in such a treatment which makes use of the overflow liquid.

The processes for silver halide color photographic materials to which the method according to the present invention can be applied are, for instance, as follows, however, it is not intended to restrict the scope of this invention to such specific examples at all:

1. color development—bleaching—(water washing-)—fixing —(water washing)—(stabilization);
2. color development—bleaching and fixing—(water washing)—(stabilization);
3. color development—bleaching—bleaching and fixing—(water washing)—(stabilization);
4. color development—bleaching—bleaching and fixing—fixing—(water washing)—(stabilization);
5. color development—bleaching—fixing—bleaching and fixing—(water washing)—(stabilization);
6. monochromatic development—water washing—(-reversing)—color development—(conditioning)—-bleaching—fixing-(water washing)—(stabilization);
7. monochromatic development—water washing—(-reversing)—color development—(conditioning)—-bleaching and fixing—(water washing)—(stabilization);
8. monochromatic development—water washing—(-reversing)—color development—(conditioning)—-bleaching—bleaching and fixing—(water washing-)—(stabilization).

In the foregoing processes, the steps in the parenthesis may be omitted in accordance with the kinds, the purposes and the applications of the photosensitive materials, however, the water washing and the stabilization processes can not simultaneously be omitted.

Each of the processing baths will now be explained below.

Color Developing Liquid

A color developing liquid used in the method of the present invention is preferably an aqueous alkaline solution containing an aromatic primary amine type color developing agent as a main component. Although aminophenolic compounds are also useful as such a color developing agent, p-phenylenediamine type compounds are preferred.

Examples of the latter compounds include 3-methyl-4-amino-N,N-diethylaniline, 3-methyl-4-amino-N-ethyl-N-beta-hydroxyethylaniline, 3-methyl-4-amino-N-ethyl-N-beta-methanesulfonamidoethylaniline, 3-methyl-4-amino-N-ethyl-N-beta-methoxyethylaniline; r sulfate, hydrochloride, phosphate, p-toluenesulfonate, tetraphenylborate and p-(tert-octyl)-benzenesulfonate thereof. These diamines are generally more stable in a salt state than in a free state and, therefore, the salts are preferably used.

Examples of the aminophenol type derivatives are o-aminophenol, p-aminophenol, 4-amino-2-methylphenol and 2-amino-3-methylphenol.

In addition, it is also possible to use those disclosed in L.F.A. Mason, "Photographic Processing Chemistry", Focal Press (1966), pp. 226 to 229; U.S. Pat. Nos. 2,193,015 and 2,592,364; and J.P. KOKAI No. 48-64933. These color developing agents may be used in combination according to need.

A color developing solution generally contains a pH buffering agent such as carbonates, borates and phosphates of alkali metals; a development inhibitor or an antifoggant such as bromides, iodides, benzimidazoles, benzothiazoles and mercapto compounds; a preservative such as hydroxylamine, triethanolamine, compounds disclosed in OLS No. 2,622,950, sulfites and bisulfites; an organic solvent such as diethylene glycol; a development accelerator such as benzyl alcohol, polyethylene glycol, quaternary ammonium salts, amines, thiocyanates and 3,6-thiaoctane-1,8-diol; a dye-forming coupler; a competing coupler; a nucleus forming agent such as sodium borohydride; an auxiliary developing agent such as 1-phenyl-3-pyrazolidone; a thickener; and a chelating agent such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaaceticacid, triethylenetetraminehexaacetic acid, aminopolycarboxylic acid as described in J.P.KOKAI No. 58-195845, 1-hydroxyethylidene-1,1'-diphosphonic acid, organic phosphonic acids as described in Research Disclosure No. 18170 (May, 1979), aminophosphonic acids such as aminotris(methylenephosphonic acid) and ethylenediamine-N,N,N',N'-tetramethylenephosphonic acid, and phosphonocarboxylic acids as described in J.P. KOKAI Nos. 52-102726, 53-42730, 54-121127, 55-4024, 55-4025, 55-126241, 55-65955 and 55-65956, and Research Disclosure No. 18170 (May, 1979).

The color developing agent is generally used in an amount of about 0.1 to about 30 g, preferably about 1 to 15 g per liter of a color developing liquid. The pH value of the color developing liquid is generally 7 or higher and most generally about 9 to about 13. Further, it is possible to use an auxiliary solution, in which the concentrations of halides, a color developing agent and the like are adjusted, so as to decrease the amount of the replenisher for the color developing bath. In an example of such a treatment employing a small amount of the replenisher, a replenisher having a bromide concentration of not more than $4\times10^{-3}$ moles/1 is replenished to the color developing bath in an amount of not more than 9 ml per 100 $cm^2$ of the processed photosensitive materials.

The processing temperature in the color developing solution preferably ranges from 20° to 50° C. and more preferably 30° to 40° C. The processing time is preferably in the range of from 20 seconds to 10 minutes and more preferably from 30 seconds to 5 minutes.

Bleaching, Bleaching and Fixing, and Fixing Liquids

The photographic emulsion layer, after the color development, is usually subjected to a bleaching process. The bleaching may be carried out at the same time with a fixing treatment, as called bleaching and fixing, or may be carried out separately.

An example of bleaching agent used in the bleaching liquid or the bleaching and fixing liquid in the present invention is a ferric ion complex which is a complex of ferric ion with a chelating agent such as aminopolycarboxylic acid, aminopolyphosphonic acid or a salt thereof. The aminopolycarboxylic acid salts or the aminopolyphosphonic acid salts are an alkali metal salt, ammonium salt or water-soluble amine salt of aminopolycarboxylic acid or aminopolyphosphonic acid. The alkali metal is, for instance, sodium, potassium and lithium and examples of water-soluble amines are alkyl amines such as methylamine, diethylamine, triethylamine and butylamine; alicyclic amines such as cyclohexylamine; arylamines such as aniline and m-toluidine; heterocyclic amines such as pyridine, morpholine and piperidine.

Typical examples of the chelating agents such as aminopolycarboxylic acid, aminopolyphosphonic acid and salts thereof are as follows, however, it should be appreciated that the scope of the present invention is not limited to the following specific examples:

Ethylenediaminetetraacetic acid;
Disodium ethylenediaminetetraacetate;
Diammonium ethylenediaminetetraacetate;
Tetra(trimethylammonium) ethylenediaminetetraacetate;
Tetrapotassium ethylenediaminetetraacetate;
Tetrasodium ethylenediaminetetraacetate;
Trisodium ethylenediaminetetraacetate;
Diethylenetriaminepentaacetic acid;
Pentasodium diethylenetriaminepentaacetate;
Ethylenediamine-N-(beta-oxyethyl)-N,N',N'-triacetic acid;
Trisodium ethylenediamine-N-(beta-oxyethyl)-N,N',N'-triacetate;
Triammonium ethylenediamine-N-(beta-oxyethyl)-N,N',N'-triacetate;
1,2-Diaminopropanetetraacetic acid;
Disodium 1,2-diaminopropanetetraacetate;
1,3-Diaminopropanetetraacetic acid;
Diammonium 1,3-diaminopropanetetraacetate;
Nitrilotriacetic acid;
Trisodium nitrilotriacetate;
Cyclohexanediaminetetraacetic acid;
Disodium cyclohexanediaminetetraacetate;
Iminodiacetic acid;
Dihydroxyethyl glycine;
Ethyl ether diaminetetraacetic acid;
Glycol ether diaminetetraacetic acid;
Ethylenediaminetetrapropionic acid;
Phenylenediaminetetraacetic acid;
1,3-Diaminopropanol-N,N,N',N'-tetramethylene phosphonic acid;
Ethylenediamine-N,N,N',N'-tetramethylene phosphonic acid; 1,3-Propylenediamine-N,N,N',N'-tetramethylene phosphonic acid.

The ferric ion complex salt may be used alone or in combination in the form of previously prepared complex salt per se or may be formed in a solution using a ferric salt, such as ferric sulfate, ferric chloride, ferric nitrate, ferric ammonium sulfate and ferric phosphate, and a chelating agent such as aminopolycarboxylic acid, aminopolyphosphonic acid and phosphonocarboxylic acid. When the complex salt is formed in a solution, one or more ferric salts may be used, and one or more chelating agents may also be used. In either case of the previously prepared complex salt or the in situ formed one, the chelating agent may be used in an excess amount greater than that required to form the desired ferric ion salt. Among these iron complexes, preferred is a complex of ferric ion with aminopolycarboxylic acid and the amount thereof used is in the range of from 0.1 to 1 mole/1, preferably 0.2 to 0.4 moles/1 in the case of the bleaching liquid for photographic color photosensitive materials such as color negative films. On the other hand, the compound is used in an amount of 0.05 to 0.5 moles/l, preferably 0.1 to 0.3 moles/l in the bleaching and fixing liquid therefor. Moreover, it is used in an amount of 0.03 to 0.3 moles/l, preferably 0.05 to 0.2 moles/l in the case of the bleaching and bleaching-fixing liquids for color photosensitive materials for print such as color paper.

To the bleaching liquid and the bleaching-fixing liquid, there may be added a bleaching accelerator according to need. Examples of such useful bleaching accelerators include compounds having a mercapto group or a disulfide group therein such as those disclosed in U.S. Pat. No. 3,893,858; German Patent Nos. 1,290,812 and 2,059,988; J.P. KOKAI Nos. 53-32736, 53-57831, 53-37418, 53-65732, 53-72633, 53-95930, 53-95631, 53-104232, 53-124424, 53-141623 and 53-28426; and Research Disclosure No. 17129 (July, 1978); thiazolidine derivatives such as those disclosed in J.P. KOKAI No. 50-140129; thiourea derivatives such as those disclosed in J.P. KOKOKU No. 45-8506, J.P. KOKAI Nos. 52-20832 and 53-32735 and U.S. Pat. No. 3,706,561; iodides such as those disclosed in German Patent No. 1,127,715 and J.P. KOKAI No. 58-16235; polyethylene oxides such as those disclosed in German Patent Nos. 966,410 and 2,748,430; polyamine compounds such as those disclosed in J.P. KOKOKU No. 45-8836; as well as compounds disclosed in J.P. KOKAI Nos. 49-42434, 49-59644, 53-94927, 54-35727, 55-26506 and 58-163940; and iodine and bromine ions. From the viewpoint of a high acceleration effect, preferred are compounds having a mercapto group or a disulfide group among others and in particular those disclosed in U.S. Pat. No. 3,893,858; German Patent No. 1,290,812 and J.P. KOKAI No. 53-95630 are preferred.

Into the bleaching or bleaching-fixing solution as used herein, bromides such as potassium bromide, sodium bromide and ammonium bromide; chlorides such as potassium chloride, sodium chloride and ammonium chloride; or iodides such as ammonium iodide may be incorporated as a rehalogenating agent. If necessary, one or more inorganic or organic acids and alkali metal or ammonium salt thereof having pH buffering ability, such as boric acid, borax, sodium metaborate, acetic acid, sodium acetate, sodium carbonate, potassium carbonate, phosphorous acid, phosphoric acid, sodium phosphate, citric acid, sodium citrate and tartaric acid; and anticorrosives such as ammonium nitrate and guanidine may be added.

The fixing agent used in the fixing or bleaching-fixing liquid may be any conventional one, for instance, thiosulfates such as sodium thiosulfate and ammonium thiosulfate; thiocyanates such as sodium thiocyanate and ammonium thiocyanate; thioethers and thioureas such as ethylenebisthioglycollic acid, 3,6-dithia-1,8-octanediol, which are water-soluble, silver halide-solubilizing agents. These agents may be used alone or in combination. Further, the special bleaching-fixing solution consisting of a combination of a fixing agent and a large amount of halide such as potassium iodide described in J.P. KOKAI No. 51-155354 may be used in the bleaching-fixing process of the method of this invention. In the present invention, preferred are thiosulfates, in particular, ammonium thiosulfate.

The concentration of the fixing agent in the fixing or bleaching-fixing solution is preferably 0.3 to 2 moles/l. In particular, in the case of processing photographic color photosensitive materials, the amount thereof is in the range of from 0.8 to 1.5 moles/l and in the case of color photosensitive materials for print, it ranges from 0.5 to 1 mole/l.

Generally, the pH value of the fixing or bleaching-fixing solution is preferably in the range of from 3 to 10, more preferably 5 to 9. This is because, if the pH is less than the lower limit, the desilvering effect is enhanced, however, the liquids are greatly impaired and the cyan dye tends to be converted to leuco dye, while if the pH is more than the upper limit, the rate of desilvering is extremely lowered and there is a strong tendency to cause stains.

In order to adjust the pH, there may be added to the liquids, for instance, hydrochloric acid, sulfuric acid, nitric acid, acetic acid, bicarbonates, ammonia, caustic soda, caustic potash, sodium carbonate and potassium carbonate according to need.

Further, various fluorescent brighteners, defoaming agents or surfactants, polyvinylpyrrolidone or organic solvents such as methanol may also be added to the bleaching-fixing solution.

The bleaching liquid and bleaching-fixing liquid as used herein contains a sulfite ion releasing compound, as the preservative, a sulfite such as sodium sulfite, potassium sulfite and ammonium sulfite; a bisulfite such as ammonium bisulfite, sodium bisulfite and potassium bisulfite; and a metabisulfite such as potassium metabisulfite, sodium metabisulfite and ammonium metabisulfite. These compounds are preferably present, in such liquids, in an amount of about 0.02 to 0.50 moles/l expressed as the amount of sulfite ions and more preferably 0.04 to 0.40 moles/l.

Furthermore, other preservatives such as ascorbic acid, carbonyl-bisulfite adducts or carbonyl compounds may be employed although the bisulfites are generally used as the preservative.

In addition to the foregoing compounds, it is also possible to add buffering agents, fluorescent brighteners, chelating agents and mold controlling agents according to need.

The silver halide photographic photosensitive materials to which the processing method according to the present invention is applied are, for instance, monochromatic color photographic photosensitive materials which comprises a substrate and a single photosensitive silver halide emulsion layer applied thereon and multilayered color photographic photosensitive materials which comprises a substrate and at least two photosensitive silver halide emulsion layers having different spectral sensitivities.

The multilayered color photographic materials comprise at least one red-sensitive emulsion layer, at least one green-sensitive emulsion layer and at least one blue-sensitive emulsion layer on the substrate. The order of these layers on the substrate is not restricted to a specific one and these may be arranged in any orders according to need. In general, a cyan dye-forming coupler is added to the red-sensitive emulsion layer, a magenta dye-forming coupler is added to the green-sensitive emulsion layer and a yellow dye-forming coupler is added to the blue-sensitive emulsion layer, however, different combinations may be adopted if necessary.

Color couplers useful in the present invention are cyan, magenta and yellow dye-forming couplers and typical examples thereof include naphtholic or phenolic compounds, pyrazolone or pyrazoloazole type compounds and open chain or heterocyclic ketomethylene compounds. Specific examples of these cyan-, magenta- and yellow-dye forming couplers which may be used in the present invention are disclosed in the patents cited in Research Disclosure No. 17643 (December, 1978), VII-D; and No. 18717 (November, 1979).

Color couplers included in the photosensitive materials are preferably made non-diffusible by imparting thereto ballast groups or polymerizing them. In the present invention, 2-equivalent color couplers in which the active site for coupling is substituted with an elimination group is rather preferred than 4-equivalent color couplers in which the active site for coupling is hydrogen atom, this is because the amount of coated silver may, thereby, be reduced and the photosensitive layer obtained has a high sensitivity. Furthermore, couplers in which a formed dye has a proper diffusibility, non-color couplers, DIR couplers which can release a development inhibitor through the coupling reaction or couplers which can release a development accelerator may also be used.

A typical yellow coupler capable of being used in the present invention is an acylacetamide coupler of an oil protect type. Examples of such yellow couplers are disclosed in U.S. Pat. Nos. 2,407,210; 2,875,057; and 3,265,506. 2-Equivalent yellow couplers are preferably used in the present invention as already explained above. Typical examples thereof are the yellow couplers of an oxygen atom elimination type described in U.S. Pat. Nos. 3,408,194; 3,447,928; 3,933,501; and 4,022,620, or the yellow couplers of a nitrogen atom elimination type described in J.P. KOKOKU No. 58-10739, U.S. Pat. Nos. 4,401,752; 4,326,024, Research Disclosure (RD) No. 18053 (April, 1979) U.K. Patent No. 1,425,020, DEOS Nos. 2,219,917; 2,261,361; 2,329,587; and 2,433,812. Alpha-pivaloyl acetanilide type couplers are excellent in fastness, particularly light fastness, of formed dye. On the other hand, alpha-benzoyl acetanilide type couplers yield high color density.

Magenta couplers which may be used in the present invention include couplers of an oil protect type of indazolone, cyanoacetyl, or, preferably, pyrazoloazole type ones such as 5-pyrazolones and pyrazolotriazole. Among 5-pyrazolone type couplers, couplers whose 3-position is substituted with an arylamino or acylamino groups are preferred from the viewpoint of color phase and color density of the formed dye. Typical examples thereof are disclosed in U.S. Pat. Nos. 2,311,082; 2,343,703; 2,600,788; 2,908,573; 3,062,653; 3,152,896; and 3,936,015. The 5-pyrazolone type coupler having ballast groups such as those described in European Patent No. 73,636 provides high color density.

As examples of pyrazoloazole type couplers, there may be mentioned such pyrazolobenzimidazoles as those disclosed in U.S. Pat. No. 3,369,879, preferably pyrazolo (5,1-c) (1,2,4)triazoles such as those disclosed in U.S. Pat. No. 3,725,067, pyrazolotetrazoles such as those disclosed in Research Disclosure No. 24220 (June, 1984) and pyrazolopyrazoles such as those disclosed in Research Disclosure No. 24230(June, 1984). Imidazo(1, 2-b)pyrazoles such as those disclosed in European Patent No. 119,741 are preferred on account of small yellow minor absorption of formed dye and light fastness. Pyrazolo(1, 5-b)(1,2,4)triazoles such as those disclosed in European Patent No. 119,860 are particularly preferred.

Cyan couplers which may be used in the present invention include naphtholic or phenolic couplers of an oil protect type. Typical examples of naphthol type couplers are those disclosed in U.S. Pat. NO. 2,474,293. Typical preferred 2-equivalent naphtholic couplers of oxygen atom elimination type are described in U.S. Pat. Nos. 4,052,212; 4,146,396; 4,228,233; and 4,296,200. Exemplary phenol type couplers are those described in U.S. Pat. Nos. 2,369,929; 2,801,171; 2,772,162; and 2,895,826.

Cyan couplers which are resistant to humidity and heat are preferably used in the present invention. Examples of such couplers are phenol type cyan couplers having an alkyl group higher than methyl group at a metha-position of a phenolic nucleus as described in U.S. Pat. No. 3,772,002; 2,5-diacylamino-substituted phenol type couplers as described in U.S. Pat. Nos. 2,772,162; 3,758,308; 4,126,396; 4,334,011; and 4,327,173; DEOS No. 3,329,729; and Japanese Patent Application Ser. No. 58-42671 (J.P. KOKAI No. 59-166956; and phenol type couplers having a phenylureido group at 2-position and an acylamino group at the 5-position of the phenol nucleus as described in U.S. Pat. Nos. 3,446,622; 4,333,999; 4,451,559; and 4,427,767.

Cyan couplers in which 5-position of naphthol nucleus is substituted with a sulfonamide or carbonamide group as described in European Patent No. 161,626 A are also excellent in fastness of formed image and may also be preferably used in the present invention.

In order to compensate unnecessary absorption, in the short wave length region, of dyes formed from magenta and cyan couplers, it is preferred to use a colored coupler together in color photosensitive materials used for taking photographs. Examples thereof are the yellow colored magenta couplers described in U.S. Pat. No. 4,163,670 and J.P. KOKOKU No. 57-39413 and the magenta colored cyan couplers described in U.S. Pat. Nos. 4,004,929 and 4,138,258, and U.K. Patent No. 1,146,368.

Graininess may be improved by using together a coupler which can form a dye having a moderate diffusibility. As such blur couplers, some magenta couplers are specifically described in U.S. Pat. No. 4,366,237 and U.K. Patent No. 2,125,570 and some yellow, magenta and cyan couplers are specifically described in European Patent No. 96,570 and DEOS No. 3,234,533.

Dye-forming couplers and the aforementioned special couplers may be a dimer or a higher polymer. Typical examples of such polymerized dye-forming couplers are described in U.S. Pat. Nos. 3,451,820 and 4,080,211. Examples of such polymerized magenta couplers are described in U.K. Pat. No. 2,102,173 and U.S. Pat. NO. 4,367,282.

These couplers may be 2-equivalent type or 4-equivalent type with respect to silver ions. Moreover, they may be a colored coupler having color compensation effect or a coupler which release a development inhibitor in the course of the development (so-called DIR couplers).

In addition to DIR couplers, the photosensitive materials may contain a colorless DIR coupling compound whose coupling reaction product is colorless and which can release a development inhibitor. The photosensitive materials may further contain other compounds which may release a development inhibitor during the development, other than DIR couplers.

Gelatin as used in the photosensitive materials processed according to the method of the present invention may be either lime-treated ones or acid-treated ones. The method for preparing such a gelatin is described, in detail, in the artile of Arthur Weiss entitled "The Macromolecular Chemistry of Gelatin", Academic Press (1964).

In photographic emulsion layers in the photographic photosensitive materials used in the present invention, any silver halide such as silver bromide, silver iodobromide, silver iodochlorobromide, silver chlorobromide and silver chloride may be employed. Preferred silver halide is silver iodobromide containing not more than 15 mole% silver iodide. Particularly preferred silver halide is silver iodobromide having a silver iodide content of 2 to 12 mole%.

The grain size of the silver halide in the photographic emulsions (the term "grain size" herein means the diameter of the grains in the case of spherical or approximately spherical grains, while if the grains are in the form of cubics, the grain size is defined as the length of their edge averaged on the projected areas thereof) is not critical in the method of this invention, however, it is preferably not more than 3 microns. The size distribution of the silver halide as used herein may be narrow or broad.

The silver halide grains in the photographic emulsion layers may be regular grains having a regular crystal form such as cubic or octahedron. Alternatively, the grains may be of an irregular crystal structure such as spherical or plate crystal or further these may be composite form comprising the foregoing crystalline forms. The grains may be composed of a mixture of grains having a variety of crystalline forms.

It is also possible to use an emulsion in which 50% of the projected area thereof is occupied with the tabular silver halide grains having a diameter 5 times larger than the thickness thereof.

The silver halide grains may have different phases in the inner part and the outer part thereof. In addition, the silver halide grains may be those which give a latent image mainly on the surface thereof or those which give a latent image mainly in the inner part thereof.

The photographic emulsions as used herein may contain a variety of compounds for the purposes of preventing fogging and stabilizing the photographic quality during the preparation of the photosensitive materials, the storage thereoforthe photographic treatment thereof. As such compounds, there may be mentioned azoles such as benzothiazolium salts, nitroimidazoles, nitroibenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (in particular, 1-phenyl-5-mercaptotetrazole); mercaptopyrimidines; mercaptotriazines; thioketo compounds as oxazolinethione; such azaindenes such as triazaindenes, tetrazaindenes (in particular, 4-hydroxy-substituted-(1,3,3a,7)-tetrazaindenes) and pentazaindenes; and such compounds known as the antifoggant or the stabilizer as benzenethiosulfonic acid, benzenesulfinic acid and benzenesulfonic acid amide.

The photographic emulsion layers or other hydrophilic colloidal layers of the photosensitive materials as used herein may further contain various kinds of surfactants which act as a coating aid, an antistatic agent, an agent for improving slipping property thereof, an emulsifier or a dispersant, an agent for preventing adhesion and an agent for improving photographic performance such as development acceleration, contrast development and sensitization.

For the purposes of improving the sensitivity and contrast and accelerating the development, the photographic emulsion layers of the photosensitive materials used in the present invention may contain, for instance, polyalkylene oxide or ether-, ester- or amine-derivatives thereof, thioether compounds, thiomorpholines, quaternary ammonium salts, urethane derivatives, urea derivatives, imidazole derivatives and 3-pyrazolidones.

In the photographic photosensitive materials as used herein, the photographic emulsion layers and other hydrophilic colloidal layers may further contain a dispension of water-insoluble or hardly water-soluble synthetic polymer for the purposes of improving the dimensional stability thereof and the like.

Examples of such polymers include those having repeating units of monomers such as alkyl acrylates, alkyl methacrylates, alkoxyalkyl acrylates, alkoxyalkyl methacrylates, glycidyl acrylates, glycidyl methacrylates, acrylamides, methacrylamides, vinyl esters (e.g., vinyl acetate), acrylonitrile, olefins, styrene or combinations thereof; or combinations of at least one of these with at least one monomer selected from the group consisting of acrylic acid, methacrylic acid, alpha, beta-unsaturated dicarboxylic acids, hydroxyalkyl acrylates, hydroxyalkyl methacrylates, sulfoalkyl acrylates, sulfoalkyl methacrylates and styrene sulfonic acid.

The photographic emulsions as used herein may spectrally be sensitized with methine dyes or others. Dyes to be used include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes, merocyanine dyes, and complex merocyanine dyes. In those dyes, any nuclei usually used in cyanine dyes may be adopted as basically reactive heterocyclic nuclei. Examples of such nuclei include pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus; nuclei composed of an alicyclic hydrocarbon ring fused with one of the foregoing nuclei; and nuclei composed of an aromatic hydrocarbon ring fused with one of the foregoing nuclei such as indolenine nucleus, benzindolenine nucleus, indole nucleus, benzoxazole nucleus, naphthoxazole nucleus, benzothizole nucleus, naphthothiazole nucleus, benzoselenazole nucleus, benzimidazole nucleus and quinoline nucleus. Those nuclei may have substituents on their carbon atoms.

For merocyanine dyes or complex merocyanine dyes, 5- or 6-membered heterocyclic nuclei such as pyrrazolin-5-one nucleus, thiohydantoin nucleus, 2-thioxazolidine-2,4-dione nucleus, thiazolidine-2,4-dione nucleus, rhodanine nucleus and thiobarbituric acid nucleus may be used as a nucleus having a ketomethylene structure.

Those sensitizing dyes may be used alone or in combination. A combination of sensitizing dyes are often used, particularly, for the purpose of supersensitization.

Substances having no spectral sensitization effect per se or substances absorbing substantially no visible light and exhibiting supersensitization effect may be incorporated into the emulsions together with the sensitizing dyes. For instance, aminostilbene compounds substituted with a nitrogen atom-containing heterocyclic group such as those disclosed in U.S. Pat. Nos. 2,933,390 and 3,635,721; organic aromatic acid-formaldehyde condensates such as those disclosed in U.S. Pat. No. 3,743,510; cadmium salts and azaindene compounds may be incorporated.

The photographic emulsion layers and other hydrophilic colloidal layers of the photographic photosensitive materials processed according to the method of this invention may contain an organic or inorganic hardening agent. Examples of such hardening agents include chromates such as chromium alum and chromium acetate; aldehydes such as formaldehyde, glyoxal and glutaraldehyde; N-methylol compounds such as dimethylol urea and methylol dimethyl hydantoin; dioxane derivatives such as 2,3-dihydroxydioxane; active vinyl compounds such as 1,35-triacryloyl-hexahydro-s-triazine and 1,3-vinylsulfonyl-2-propanol; active halogen compounds such as 2,4-dichloro-6-hydroxy-s-triazine; mucohalogeno-acids such as mucochloric acid and mucophenoxychloric acid. These hardening agents may be used alone or in combination.

In the photosensitive materials to be processed according to the method of this invention, when the hydrophilic colloidal layers contain dyes and/or ultraviolet absorbers, they may be stained with a cationic polymer.

The photosensitive materials processed according to the method of this invention may contain an anticolor-foggant such as a hydroquinone derivative, an aminophenol derivative, gallic acid derivatives and ascorbic acid derivatives.

The photosensitive materials processed according to the method of this invention may contain an ultraviolet absorber in the hydrophilic colloidal layers thereof. Examples of such ultraviolet absorbers include benzotriazole compounds substituted with an aryl group such as those disclosed in U.S. Pat. No. 3,533,794; 4-thiazolidone compounds such as those disclosed in U.S. Pat. Nos. 3,314,794 and 3,352,681; benzophenone compounds such as those disclosed in J.P. KOKAI No. 46-2784; cinnamate compounds such as those disclosed in U.S. Pat. Nos. 3,705,805 and 3,707,375; butadiene compounds such as those disclosed in U.S. Pat. No. 4,045,229; and benzoxazole compounds such as those disclosed in U.S. Pat. No. 3,700,455. Moreover, it may also possible to use, for instance, an ultraviolet absorbing coupler such as alphanaphtholic cyan dye-forming couplers or an ultraviolet absorbing polymer. These ultraviolet absorbers may be stained in a specific layer of the photosensitive materials.

The hydrophilic colloidal layers of the photosensitive materials processed according to the method of this invention may contain a water-soluble dye as a filter dye or for a variety of purposes such as prevention of irradiation and the like. Examples of such dyes include oxonol dyes, hemioxonol dyes, styryl dyes, merocyanine dyes, cyanine dyes and azo dyes. Among these, oxonol dyes, hemioxonol dyes and merocyanine dyes are useful in the invention.

The photosensitive materials as used herein may further contain the following known antidiscoloration agents and the color image stabilizers incorporated into the photosensitive materials may be used alone or in combination. Examples of the known antidiscoloration agents are hydroquinone derivatives, gallic acid derivatives, p-alkoxyphenols, p-oxyphenol derivatives and bisphenols.

The compounds represented by the general formula (A) and the couplers as used herein may be incorporated into the photosensitive materials in accordance with a variety of known dispersion methods.

Examples of high-boiling point solvents used in the oil-in-water dispersion method are disclosed in, for instance, U.S. Pat. No. 2,322,027.

The processes of a latex dispersion method, effects attained by the method and specific examples of latexes for impregnation are described in, for instance, U.S. Pat. No. 4,199,363 and OLS Nos. 2,541,274 and 2,541,230.

The method for processing silver halide photographic photosensitive materials according to the present invention will hereunder be explained in more detail with reference to the following non-limitative working examples and the effects practically achieved according to the method of this invention will also be discussed in detail in comparison with the following comparative examples.

EXAMPLE 1

A multilayered color photosensitive material (hereunder referred to as Sample 101) was prepared by applying, in order, the following layers, each of which had the composition given below, on a substrate of cellulose triacetate film provided with an underlying coating.

(Composition of the Photosensitive Layer)

In the following composition, each component was represented by coated amount expressed as g/m$^2$, while as to silver halide, the amount was represented by coated amount expressed as a reduced amount of silver, provided that the amounts of sensitizing dyes and couplers were represented by coated amount expressed as molar amount per unit mole of silver halide included in the same layer.

(Sample 101)

| | |
|---|---|
| 1st Layer: Halation Inhibiting Layer | |
| Black colloidal silver | 0.18 (silver) |
| Gelatin | 0.40 |
| 2nd Layer: Intermediate Layer | |
| 2,5-Di-tert-pentadecylhydroquinone | 0.18 |
| EX-1 | 0.07 |
| EX-3 | 0.02 |
| EX-16 | 0.004 |
| U-1 | 0.08 |
| U-2 | 0.08 |
| HBS-1 | 0.10 |
| HBS-2 | 0.02 |
| Gelatin | 1.04 |
| 3rd Layer: First Red-sensitive Emulsion Layer | |
| Silver iodobromide emulsion (AgI content = 6 mole %; average grain size = 0.6 microns) | 0.55 (silver) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 1.20 |
| 4th Layer: Second Red-sensitive Emulsion Layer | |
| Silver iodobromide emulsion (AgI content = 8 mole %; average grain size = 0.8 microns) | 1.0 (silver) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.300 |
| EX-3 | 0.050 |
| EX-10 | 0.015 |
| HBS-2 | 0.050 |
| Gelatin | 1.30 |
| 5th Layer: Third Red-sensitive Emulsion Layer | |
| Silver iodobromide emulsion (AgI content = 16 mole %; average grain size = 1.1 microns) | 1.60 (silver) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-5 | 0.150 |
| EX-3 | 0.055 |
| EX-4 | 0.060 |
| HBS-1 | 0.32 |
| Gelatin | 1.63 |
| 6th Layer: Intermediate Layer | |
| Gelatin | 1.06 |

-continued

| | |
|---|---|
| 7th Layer: First Green-sensitive Emulsion Layer | |
| Silver iodobromide emulsion (AgI content = 6 mole %; average grain size = 0.6 microns) | 0.40 (silver) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.030 |
| Gelatin | 0.75 |
| 8th Layer: Second Green-sensitive Emulsion Layer | |
| Silver iodobromide emulsion (AgI content = 9 mole %; average grain size = 0.7 microns) | 0.80 (silver) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-13 | 0.018 |
| EX-8 | 0.010 |
| EX-1 | 0.008 |
| EX-7 | 0.012 |
| HBS-1 | 0.60 |
| HBS-4 | 0.10 |
| Gelatin | 1.10 |
| 9th Layer: Third Green-sensitive Emulsion Layer | |
| Silver iodobromide emulsion (AgI content = 12 mole %; average grain size = 1.0 microns) | 1.2 (silver) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-13 | 0.030 |
| EX-1 | 0.025 |
| HBS-2 | 0.55 |
| HBS-4 | 0.05 |
| Gelatin | 1.74 |
| 10th Layer: Yellow Filter Layer | |
| Yellow colloidal silver | 0.05 (silver) |
| A-1 | 0.15 |
| HBS-1 | 0.03 |
| Gelatin | 0.95 |
| 11th Layer: First Blue-sensitive Emulsion Layer | |
| Silver iodobromide emulsion (AgI content = 6 mole %; average grain size = 0.6 microns) | 0.24 (silver) |
| Sensitizing dye VIII | $3.5 \times 10^{-4}$ |
| EX-9 | 0.85 |
| EX-8 | 0.12 |
| HBS-1 | 0.28 |
| Gelatin | 1.28 |
| 12th Layer: Second Blue-sensitive Emulsion Layer | |
| Silver iodobromide emulsion (AgI content = 10 mole %; average grain size = 0.8 microns) | 0.45 (silver) |
| Sensitizing dye VIII | $2.1 \times 10^{-4}$ |
| EX-11 | 0.20 |
| EX-10 | 0.015 |
| HBS-1 | 0.03 |
| Gelatin | 0.46 |
| 13th Layer: Third Blue-sensitive Emulsion Layer | |
| Silver iodobromide emulsion (AgI content = 1 mole %; average grain size = 1.3 microns) | 0.77 (silver) |
| Sensitizing dye VIII | $2.2 \times 10^{-4}$ |
| EX-11 | 0.20 |
| HBS-1 | 0.07 |
| Gelatin | 0.69 |
| 14th Layer: First Protective Layer | |
| Silver iodobromide emulsion (AgI content = 1 mole %; average grain size = 0.07 microns) | 0.5 (silver) |
| U-1 | 0.11 |
| U-2 | 0.17 |
| HBS-1 | 0.90 |
| Gelatin | 1.00 |

-continued

| 15th Layer: Second Protective Layer | |
|---|---|
| Particles of polymethylacrylate (diameter = about 1.5 microns) | 0.54 |
| S-1 | 0.05 |
| S-2 | 0.20 |
| Gelatin | 0.72 |

To each layer, there were added a gelatin hardening agent H-1 and a surfactant in addition to the aforementioned components.

(Samples 102 and 103)

These Samples 102 and 103 were prepared according to the same procedures as those for preparing Sample 101 except that A-1 used in the composition of the tenth layer (yellow filter layer) was replaced with the compounds (6) and (13) of the present invention respectively in an amount of 15 g/m$^2$ (coated amount).

(Samples 104, 105 and 106)

These Samples 104, 105 and 106 were prepared according to the same procedures as those for preparing Samples 101, 102 and 103 except that each one of a comparative compound A-1 and the compounds(6) and (13) of the present invention was added to each of the sixth layers of Samples 101, 102 and 103 respectively in an amount of 15 g/m$^2$ (coated amount) and that 0.05 g/m$^2$ of HBS-1 was added to each of the sixth layers.

Sample 101 among thus prepared Samples was cut into long band-like films of 35 mm wide and a photograph was taken using such long band-like films under the standard exposure conditions.

The photographed Sample 101 was processed, at a rate of 100 m/day for 10 days, in accordance with each of the treatments No. 1 to No. 6 which were prepared by changing the amount of the washing water and the compositions thereof shown in Table I.

TABLE I

| Steps | Processing time (sec.) | Processing Temp. (°C.) | Amount(*1) replenished (ml) | Tank Volume (l) |
|---|---|---|---|---|
| Color Development | 195 | 38 | 45 | 10 |
| Bleaching | 60 | 38 | 20 | 4 |
| Bleaching-Fixing | 195 | 38 | 30 | 10 |
| Water Washing (1) | 40 | 35 | (*2) | 4 |
| Water Washing (2) | 60 | 35 | see Table II | 4 |
| Stabilization | 40 | 38 | 20 | 4 |
| Drying | 75 | 55 | | |

(*1)This is expressed as the amount replenished per unit length (1 m) of Sample (35 mm wide).
(*2)The replenishment was effected by countercurrent piping system from (2) to (1).

In this connection, the processor used was NEGA Processor FP-350 for MINILABO CHAMPION 23S available from Fuji Photo Film Co. Ltd. and in this processor, the amount of the bleaching-fixing liquid carried over to the water washing process was 2.0 ml per unit length (1 m) of the processed Sample having a width of 35 mm.

| (Color Developing Liquid) Component | Tank Solution (g) | Replenisher (g) |
|---|---|---|
| Diethylenetriamine-pentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 (mg) | — |
| Hydroxylamine sulfate | 2.4 | 2.8 |
| 4-(N-ethyl-N-beta-hydroxyethylamino)-2-methylaniline sulfate | 4.5 | 5.5 |
| Water (tap water) | ad. 1.0 (l) | ad. 1.0 (l) |
| pH | 10.05 | 10.10 |

| (Bleaching Liquid): | Tank Solution and Replenisher (g) |
|---|---|
| Ferric ammonium ethylenediaminetetraacetate dihydrate | 120.0 |
| Disodium ethylenediaminetetraacetate | 10.0 |
| Ammonium bromide | 100.0 |
| Ammonium nitrate | 10.0 |
| Bleaching accelerator | 0.0005 (mole) |

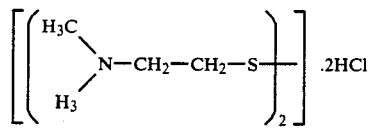

| | |
|---|---|
| 27% Aqueous ammonia | 15.0 (ml) |
| Water (tap water) | ad. 1.0 (l) |
| pH | 6.3 |

| (Bleaching-Fixing Liquid): | Tank Solution and Replenisher (g) |
|---|---|
| Ferric ammonium ethylenediaminetetraacetate dihydrate | 50.0 |
| Disodium ethylenediaminetetraacetate | 5.0 |
| Sodium sulfite | 12.0 |
| Ammonium thiosulfate (70% aqueous solution) | 240.0 (ml) |
| 27% Aqueous ammonia | 6.0 (ml) |
| Water | ad. 1.0 (l) |
| pH | 7.2 |

| (Washing Water): | Tank Solution and Replenisher |
|---|---|
| Washing water I: Tap water | |
| calcium | 45 mg/l |
| magnesium | 7 mg/l |
| pH | 7.0 |
| conductivity | 370 microS/cm |

Washing Water II: Tap water was passed through a mixed-bed type column packed with H-type strong acidic cation exchange resin (manufactured and sold by Rohm & Haas Co. under the trade name of Amberlite IR-120B) and OH-type anion exchange resin (manufactured and sold by the same company under the trade name of Amberlite IR-400) to obtain Washing Water II exhibiting the following properties:

| | |
|---|---|
| calcium | 0.3 mg/l |
| magnesium | not more than 0.1 mg/l |
| pH | 6.5 |
| conductivity | 5.0 microS/cm |

Washing Water III: This was prepared by adding, to the washing water II, 20 mg/l of sodium dichloroisocyanurate and 130 mg/l of anhydrous sodium sulfate. Properties thereof were as follows:

| | |
|---|---|
| calcium | 0.3 mg/l |
| magnesium | not more than 0.1 mg/l |

-continued

| | |
|---|---|
| pH | 6.6 |
| conductivity | 150 microS/cm |
| (Stabilization Liquid): Tank Solution and Replenisher (g) | |
| Formalin (37%) | 2.0 (ml) |
| Polyoxyethylene-p-monononylphenyl-ether (average degree of polymerization = 10) | 0.3 |
| Disodium ethylenediaminetetraacetate | 0.05 |
| Water (tap water) | ad. 1.0 (l) |
| pH | 5.0 to 8.0 |

After the completion of each treatment, Samples 101 to 106 were subjected to 20 CMS wedge exposure to light at a color temperature of 4,800° K.

These Samples were stored under a constant temperature and humidity (70° C.; RH (relative humidity)=80%) for 4 weeks and the degree of discoloration of cyan dye at the portion having highest density, the sweating phenomenon and the turbidity of water in the water washing baths due to the proliferation of bacteria were determined, the results obtained being summarized in Table II.

As seen from the results listed in Table II, when photosensitive materials are processed in accordance with the present invention, the degree of discoloration of cyan dye and the sweating phenomenon are low. Moreover, when washing water from which calcium and magnesium are removed is used, the water in the water washing tanks never becomes turbid, that is the proliferation of bacteria is not observed.

TABLE II

| Test No. | Sample No. | Degree of Discoloration (%) | Turbidity of Water in Bath | Sweating Phenomenon |
|---|---|---|---|---|
| (Treatment No. 1: Washing Water I: Amount Thereof = 400 (200**) ml/1 m) | | | | |
| 1(*) | 101 | 14 | (−) | (−) |
| 2(*) | 104 | 14 | (−) | (−) |
| 3(*) | 103 | 14 | (−) | (−) |
| 4(*) | 106 | 14 | (−) | (−) |
| (Treatment No. 2: Washing Water I: Amount Thereof = 30 (15**) ml/1 m) | | | | |
| 5(*) | 101 | 23 | (++) | (++) |
| 6(*) | 104 | 23 | (++) | (++) |
| 7 | 103 | 19 | (++) | (−) |
| 8 | 106 | 16 | (++) | (−) |
| (Treatment No. 3: Washing Water I: Amount Thereof = 10 (5**) ml/1 m) | | | | |
| 9(*) | 101 | 27 | (++) | (++) |
| 10(*) | 104 | 27 | (++) | (++) |
| 11 | 103 | 22 | (++) | (+) |
| 12 | 106 | 16 | (++) | (+) |
| (Treatment No. 4: Washing Water II: Amount Thereof = 30 (15**) ml/1 m) | | | | |
| 13 | 102 | 20 | (−) | (−) |
| 14 | 105 | 17 | (−) | (−) |
| 15 | 103 | 19 | (−) | (−) |
| 16 | 106 | 16 | (−) | (−) |
| (Treatment No. 5: Washing Water II: Amount Thereof = 10 (5**) ml/1 m) | | | | |
| 17 | 102 | 23 | (−) | (+) |
| 18 | 105 | 17 | (−) | (+) |
| 19 | 103 | 22 | (−) | (−) |
| 20 | 106 | 16 | (−) | (−) |
| (Treatment No. 6: Washing Water III: Amount Thereof = 30 (15**) ml/1 m | | | | |
| 21 | 102 | 20 | (−) | (−) |
| 22 | 105 | 17 | (−) | (−) |
| 23 | 103 | 19 | (−) | (−) |
| 24 | 106 | 16 | (−) | (−) |

(*)This means Comparative Example;
**This means the amount carried over from the preceding bath.
Explanation of the Ideograms in Table II:
(−)not observed;
(+)observed (in small extent);
(++)observed (in great extent).

EXAMPLE 2

Sample 101 obtained in Example 1 was cut into long band-like films of 35 mm wide and photographs were taken using Sample 101 as in Example 1.

The photographed Sample 101 was processed, at a rate of 100 m/day for 10 days, in accordance with each of the treatments No. 1 to No. 6 which were prepared by changing the amount of the washing water and the compositions thereof shown in Table III, respectively.

TABLE III

| Steps | Processing time (sec.) | Processing Temp. (°C.) | Amount(*1) replenished (ml) | Tank Volume (l) |
|---|---|---|---|---|
| Color Development | 195 | 37.8 | 50 | 10 |
| Bleaching | 390 | 37.8 | 10 | 20 |
| Fixing | 195 | 37.8 | 30 | 10 |
| Water Washing (1) | see Table IV | 35.0 | (*2) | 4 |
| Water Washing (2) | see Table IV | 35.0 | see Table IV | 4 |
| Stabilization | 80 | 37.8 | 30 | 4 |
| Drying | 90 | 52.0 | | |

(*1)This is expressed as the amount replenished per unit area (1 m) of Sample (35 mm wide).
(*2)The replenishment was effected by countercurrent piping system from (2) to (1).

Each treating liquid used in these processings had the following compositions.

| (Color Developing Liquid) Component | Tank Solution (g) | Replenisher (g) |
|---|---|---|
| Diethylenetriamine-pentaacetic acid | 5.0 | 6.0 |
| Sodium sulfite | 4.0 | 4.4 |
| Potassium carbonate | 30.0 | 37.0 |
| Potassium bromide | 1.3 | 0.9 |
| Potassium iodide | 1.2 (mg) | — |
| Hydroxylamine sulfate | 2.0 | 2.8 |
| 4-(N-ethyl-N-beta-hydroxy-ethylamino)-2-methylaniline sulfate | 4.7 | 5.3 |
| Water | ad. 1.0 (l) | ad. 1.0 (l) |
| pH | 10.00 | 10.05 |

| (Bleaching Liquid) | Tank Solution (g) | Replenisher (g) |
|---|---|---|
| Ferric ammonium ethylenediamine-tetraacetate dihydrate | 100.0 | 120.0 |
| Disodium ethylenediaminetetra-acetate dihydrate | 10.0 | 12.0 |
| Ammonium bromide | 160.0 | 180.0 |
| Ammonium nitrate | 30.0 | 50.0 |
| 27% Aqueous ammonia | 7.0 (ml) | 5.0 (ml) |
| Water | ad. 1.0 (l) | ad. 1.0 (l) |
| pH | 6.0 | 5.7 |

| (Fixing Liquid) | Tank Solution (g) | Replenisher (g) |
|---|---|---|
| Disodium ethylenediaminetetra-acetate | 0.5 | 0.7 |
| Sodium sulfite | 7.0 | 8.0 |

-continued

| | | |
|---|---|---|
| Sodium bisulfite | 5.0 | 5.5 |
| Ammonium thiosulfate (70% aqueous solution) | 170.0 (ml) | 200.0 (ml) |
| Water | ad. 1.0 (l) | ad. 1.0 (l) |
| pH | 6.7 | 6.6 |

| | |
|---|---|
| (Washing Water): | Tank Solution and Replenisher |
| Washing water I: | The same as Washing Water I in Example 1. |
| Washing Water IV: | |
| 5-cloro-2-methyl-4-isothiazolin-3-one | 6.0 mg |
| 2-methyl-4-isothiazolin-3-one | 3.0 mg |
| ethylene glycol | 1.5 |
| water (tap water) | ad. 1.0 (l) |
| pH | 5.0 to 7.0 |

| (Stabilization Liquid): | Tank Solution and Replenisher (g) |
|---|---|
| Formalin (37%) | 3.0 (ml) |
| Ethylene glycol | 2.0 |
| Surfactant | 0.4 |

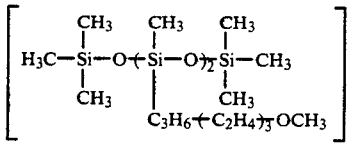

| | |
|---|---|
| Water (tap water) | ad. 1.0 (l) |
| pH | 5.0 to 8.0 |

After the completion of each treatment, Samples 101 to 106 were subjected to 20 CMS wedge exposure to light at a color temperature of 4,800° K.

In the same manner as in Example 1, the discoloration, the stains and the sweating phenomenon were inspected on Samples thus treated.

As seen from the results summarized in Table IV, it was found that the method of the present invention provided the same effects as those observed in Example 1. That is, the method of this invention makes it possible to eliminate the lowering of the image stability while the water washing time was substantially shortened.

TABLE IV

| Test No. | Sample No. | Degree of Discoloration (cyan dye; %) | Yellow Stains (density) | Sweating Phenomenon (**) |
|---|---|---|---|---|
| (Treatment No. 7: Washing Water I: Amount Thereof = 400/200 (amount replenished/amount carried over): Washing Time = 90 sec./90 sec. (Washing(1)/Washing(2))) | | | | |
| 1(*) | 101 | 11 | +0.03 | (−) |
| 2(*) | 104 | 11 | +0.03 | (−) |
| 3(*) | 103 | 11 | +0.03 | (−) |
| 4(*) | 106 | 11 | +0.03 | (−) |
| (Treatment No. 8: Washing Water I: Amount Thereof = 30/15 (amount replenished/amount carried over): Washing Time = 90 sec./90 sec. (Washing(1)/Washing(2))) | | | | |
| 5(*) | 101 | 22 | +0.07 | (++) |
| 6(*) | 104 | 22 | +0.07 | (++) |
| 7 | 103 | 17 | +0.03 | (−) |
| 8 | 106 | 11 | +0.03 | (−) |
| (Treatment No. 9: Washing Water IV: Amount Thereof = 30/15 (amount replenished/amount carried over): Washing Time = 90 sec./90 sec. (Washing(1)/Washing(2))) | | | | |
| 9(*) | 101 | 22 | +0.07 | (++) |
| 10(*) | 104 | 22 | +0.07 | (++) |
| 11 | 103 | 17 | +0.03 | (−) |
| 12 | 106 | 12 | +0.03 | (−) |
| (Treatment No. 10: Washing Water IV: Amount Thereof = 30/15 (amount replenished/amount carried over): Washing Time = 60 sec./60 sec. (Washing(1)/Washing(2))) | | | | |
| 13(*) | 101 | 24 | +0.08 | (++) |

TABLE IV-continued

| Test No. | Sample No. | Degree of Discoloration (cyan dye; %) | Yellow Stains (density) | Sweating Phenomenon (**) |
|---|---|---|---|---|
| 14(*) | 104 | 24 | +0.08 | (++) |
| 15 | 103 | 19 | +0.04 | (−) |
| 16 | 106 | 13 | +0.04 | (−) |
| (Treatment No. 11: Washing Water IV: Amount Thereof = 30/10 (amount replenished/amount carried over): Washing Time = 40 sec./40 sec. (Washing(1)/Washing(2))) | | | | |
| 17(*) | 101 | 28 | +0.11 | (++) |
| 18(*) | 104 | 28 | +0.10 | (++) |
| 19 | 103 | 21 | +0.04 | (−) |
| 20 | 106 | 15 | +0.04 | (−) |
| 21 | 102 | 22 | +0.04 | (+) |
| 22 | 105 | 16 | +0.05 | (+) |

(*): This means Comparative Example;
(**): Estimation of the sweating phenomenon is the same as in Example 1.

EXAMPLE 3

The procedures of Example 1 were repeated except that the treatments were modified as shown in the following Table V and the washing water was replaced with the stabilization liquids having the compositions listed below.

TABLE V

| Steps | Processing time (sec.) | Processing Temp. (°C.) | Amount(*1) replenished (ml) | Tank Volume (l) |
|---|---|---|---|---|
| Color Development | 195 | 37.8 | 40 | 10 |
| Bleaching | 180 | 37.8 | 5 | 10 |
| Fixing | 240 | 37.8 | 30 | 10 |
| Stabilization (1) | 45 | 35.0 | (*2) | 5 |
| Stabilization (2) | 45 | 35.0 | | 5 |
| Stabilization (3) | 45 | 35.0 | | 5 |
| Drying | 80 | 55.0 | | |

(*1): This is expressed as the amount replenished per unit length (1 m) of Sample (35 mm wide).
(*2): The replenishment was effected by countercurrent piping system from (3) to (1).

The composition of each treating liquid was as follows, respectively.

| Component | Tank Solution (g) | Replenisher (g) |
|---|---|---|
| (Color Developing Liquid) | | |
| Diethylenetriamine-pentaacetic acid | 5.0 | 6.0 |
| Sodium sulfite | 4.0 | 4.4 |
| Potassium carbonate | 30.0 | 37.0 |
| Potassium bromide | 1.3 | 0.9 |
| Potassium iodide | 1.2 (mg) | — |
| Hydroxylamine sulfate | 2.0 | 2.8 |
| 4-(N-ethyl-N-beta-hydroxy-ethylamino)-2-methylaniline sulfate | 4.7 | 5.3 |
| Water | ad. 1.0 (l) | ad. 1.0 (l) |
| pH | 10.00 | 10.05 |
| (Bleaching Liquid) | | |
| Ferric ammonium ethylenediamine-tetraacetate dihydrate | 70.0 | 120.0 |
| Ferric 1,3-diaminopropanetetra-acetate | 35.0 | 55.0 |
| Ethylenediaminetetraacetic acid | 4.0 | 5.0 |
| Ammonium bromide | 100.0 | 160.0 |
| Ammonium nitrate | 30.0 | 50.0 |
| 27% Aqueous ammonia | 20.0 (ml) | 23.0 (ml) |
| 98% Acetic acid | 9.0 (ml) | 15.0 (ml) |
| Water | ad. 1.0 (1) | ad. 1.0 (1) |

-continued

| Component | Tank Solution (g) | Replenisher (g) |
|---|---|---|
| pH | 5.5 | 4.5 |
| (Fixing Liquid) | | |
| Disodium ethylenediaminetetra-acetate | 0.5 | 0.7 |
| Sodium sulfite | 7.0 | 8.0 |
| Sodium bisulfite | 5.0 | 5.5 |
| Ammonium thiosulfate (70% aqueous solution) | 170.0 (ml) | 200.0 (ml) |
| Water | ad. 1.0 (l) | ad. 1.0 (l) |
| pH | 6.7 | 6.6 |

(Stabilization Liquid): Tank Solution and Replenisher (g) Stabilization Liquid I Used Instead of Washing Water I in Example 1:

| | |
|---|---|
| Tap Water of Example 1 | 1.0 (l) |
| Formalin (37%) | 1.2 (ml) |
| 5-Chloro-2-methyl-4-isothiazolin-3-one | 6.0 (mg) |
| 2-Methyl-4-isothiazolin-3-one | 3.0 (mg) |
| Sufactant ($C_{10}H_{21}$—O—$(CH_2CH_2O)_{10}$—H) | 0.4 |
| Ethylene glycol | 1.0 |

Stabilization Liquid II Used Instead of Washing Water II in Example 1:

Stabilization Liquid II was prepared in accordance with the same procedures as those for preparing Stabilization Liquid I except that in the above Stabilization Liquid I, Washing Water II of Example 1 was used instead of tap water.

Stabilization Liquid III Used Instead of Washing Water III in Example 1:

Stabilization Liquid III was prepared in the same manner as for the preparation of Stabilization Liquid I except that Washing Water III of Example 1 was used instead of tap water.

The results thus obtained were substantially the same as those in Example 1 and it was confirmed that the method according to the present invention was likewise effective when stabilization baths were used in place of water washing baths.

EXAMPLE 4

The same procedures as in Example 1 were repeated, unless otherwise specified, except that the treatments in Example 1 were modified as shown in Table VI.

TABLE VI

| Steps | Processing time (sec.) | Processing Temp. (°C.) | Amount(*1) replenished (ml) | Tank Volume (l) |
|---|---|---|---|---|
| Color Development | 150 | 40 | 10 | 8 |
| Bleaching-Fixing | 180 | 40 | 20 | 8 |
| Water Washing(1) | 20 | 35 | (*2) | 2 |
| Water Washing(2) | 20 | 35 | see Table VII | 2 |
| Stabilization | 20 | 35 | 10 | 2 |
| Drying | 50 | 65 | | |

(*1): This is expressed as the amount replenished per unit length (1 m) of Sample (35 mm wide).

(*2): The replenishment was effected by countercurrent piping system from (2) to (1).

In the treatments as shown in Table VI, whole the overflow liquid from the water washing process (1) was introduced into the preceding bleaching-fixing bath.

Each treating liquid used in these processings had the following compositions.

| (Color Developing Liquid) Component | Tank Solution (g) | Replenisher (g) |
|---|---|---|
| Diethylenetriamine-pentaacetic acid | 2.0 | 2.2 |
| 1-Hydroxyethylidene-1,1-diphosphonic acid | 3.0 | 3.2 |
| Sodium sulfite | 4.0 | 5.5 |
| Potassium carbonate | 30.0 | 45.0 |
| Potassium bromide | 1.4 | — |
| Potassium iodide | 1.5 (mg) | — |
| Hydroxylamine sulfate | 2.4 | 3.0 |
| 4-(N-ethyl-N-beta-hydroxy-ethylamino)-2-methylaniline sulfate | 4.5 | 7.5 |
| Water | ad. 1.0 (l) | ad. 1.0 (l) |
| pH | 10.5 | 10.20 |

| (Bleaching-Fixing Liquid): | Tank Solution and Replenisher (g) |
|---|---|
| Ferric ammonium ethylenediamine-tetraacetate dihydrate | 120 |
| Disodium ethylenediaminetetra-acetate | 15 |
| Sodium sulfite | 20 |
| Ammonium thiosulfate (70% aqueous solution) | 400 (ml) |
| 98% Acetic acid | 5 (ml) |
| Bleaching Accelerator | 0.01 (mole) |

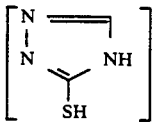

| | |
|---|---|
| Water | ad. 1.0 (l) |
| pH | 6.5 |

(Washing Water): Washing Water I, Washing Water II and Washing Water III used were the same as those used in Example 1.

(Stabilization Liquid): Tank Solution and Replenisher (g)

| | |
|---|---|
| Formalin (37%) | 2.0 (ml) |
| Polyoxyethylene-p-monononyl-phenylether (average degree of polymerization = 10) | 0.3 |
| Disodium ethylenediaminetetraacetate | 0.05 |
| Water | ad. 1.0 (l) |
| pH | 5.0 to 8.0 |

The results thus obtained are summarized in the following Table VII.

In the treatment No. 12, only 10 ml of the overflow liquid per unit length (1 m) of the photosensitive material (35 mm wide) treated was introduced into the bleaching-fixing bath and the remaining overflow liquid was discharged as it was.

TABLE VII

| Test No. | Sample No. | Degree of Discoloration (magenta dye; %) | Yellow Stains (density) | Sweating Phenomenon (**) |
|---|---|---|---|---|
| (Treatment No. 12: Washing Water I: Amount Thereof = 400/200 (amount replenished/amount carried over)) | | | | |
| 1(*) | 101 | 7 | +0.04 | (−) |

TABLE VII-continued

| Test No. | Sample No. | Degree of Discoloration (magenta dye; %) | Yellow Stains (density) | Sweating Phenomenon (**) |
|---|---|---|---|---|
| 2(*) | 104 | 7 | +0.04 | (−) |
| 3(*) | 103 | 7 | +0.04 | (−) |
| 4(*) | 106 | 7 | +0.04 | (−) |
| (Treatment No. 13: Washing Water I: Amount Thereof = 10/5 (amount replenished/amount carried over)) | | | | |
| 5(*) | 101 | 14 | +0.12 | (++) |
| 6(*) | 104 | 14 | +0.12 | (++) |
| 7 | 103 | 12 | +0.05 | (+) |
| 8 | 106 | 8 | +0.05 | (+) |
| (Treatment No. 14: Washing Water II: Amount Thereof = 10/5 (amount replenished/amount carried over)) | | | | |
| 9(*) | 101 | 14 | +0.12 | (++) |
| 10(*) | 104 | 14 | +0.12 | (++) |
| 11 | 103 | 12 | +0.05 | (−) |
| 12 | 106 | 8 | +0.05 | (−) |
| 13 | 102 | 13 | +0.06 | (+) |
| 14 | 105 | 9 | +0.06 | (+) |
| (Treatment No. 15: Washing Water III: Amount Thereof = 10/5 (amount replenished/amount carried over)) | | | | |
| 15(*) | 101 | 14 | +0.12 | (++) |
| 16(*) | 104 | 14 | +0.12 | (++) |
| 17 | 103 | 12 | +0.05 | (−) |
| 18 | 106 | 8 | +0.05 | (−) |
| 19 | 102 | 13 | +0.06 | (+) |
| 20 | 105 | 9 | +0.06 | (+) |

(*): This means Comparative Example;
(**): Estimation of the sweating phenomenon is the same as in Example 1.

As shown in Table VII, in the method of this invention, the water washing time is extremely shortened and it is possible to make the effective use of the method according to the present invention in a quick treatment in which the bleaching-fixing treatment is effected immediately after the color development. Moreover, the method of this invention is effective not only to prevent the discoloration of cyan dye as evidenced in Examples 1 and 2 but also to prevent the discoloration of magenta dye as demonstrated in Example 4.

In the treatments Nos. 12 and 13 in which Washing Water I was used, floating matters were generated in both the bleaching-fixing bath and the water washing baths, the desilvering was partially incomplete due to the attachment of the floating matters and thus the contamination of the treated photosensitive material was observed. However, such a problem was not observed in the treatments Nos. 14 and 15 in which Washing Waters II and III were used.

EXAMPLE 5

The same procedures as those in Example 4 were repeated except that Washing Water II was used and that the amount of Washing Water varied. The results thus obtained are summarized in Table VIII below.

TABLE VIII

| Test No. | Sample No. | Degree of Discoloration (magenta dye; %) | Yellow Stains (density) | Sweating Phenomenon (**) |
|---|---|---|---|---|
| (Treatment No. 15: Washing Water II: Amount Thereof = 200/100 (amount replenished/amount carried over)) | | | | |
| 1(*) | 104 | 8 | +0.04 | (−) |
| 2(*) | 106 | 8 | +0.04 | (−) |
| (Treatment No. 16: Washing Water II: Amount Thereof = 100/50 (amount replenished/amount carried over)) | | | | |
| 3(*) | 104 | 12 | +0.09 | (+) |
| 4 | 106 | 8 | +0.04 | (−) |
| (Treatment No. 17: Washing Water II: Amount Thereof = 30/10 (amount replenished/amount carried over)) | | | | |
| 5(*) | 104 | 13 | +0.12 | (++) |
| 6 | 106 | 8 | +0.05 | (−) |
| (Treatment No. 18: Washing Water II: Amount Thereof = 6/3 (amount replenished/amount carried over)) | | | | |
| 7(*) | 104 | 17 | +0.14 | (++) |
| 8 | 106 | 10 | +0.06 | (−) |
| (Treatment No. 19: Washing Water II: Amount Thereof = 2/1 (amount replenished/amount carried over)) | | | | |
| 9(*) | 104 | 19 | +0.17 | (++) |
| 10 | 106 | 13 | +0.09 | (+) |
| (Treatment No. 20: Washing Water II: Amount Thereof = 1/0.5 (amount replenished/amount carried over)) | | | | |
| 11(*) | 104 | 21 | +0.19 | (++) |
| 12(*) | 106 | 20 | +0.18 | (++) |

(*): This means Comparative Example;
(**): Estimation of the sweating phenomenon is the same as in Example 1.

As discussed above in detail, it is clear that the method of the present invention is certainly effective if the ratio between the amount of the replenisher and the amount of the liquid carried over ranges from 1 to 50.

The structure of the compounds used in Example 1 are as follows:

U-1

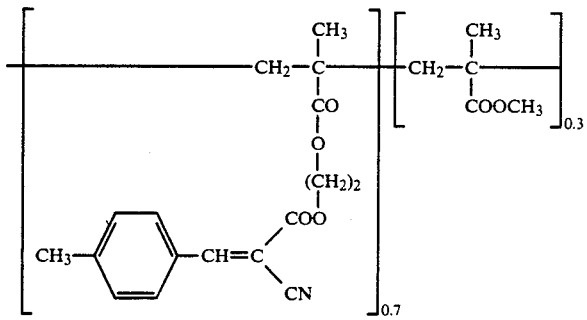

U-2

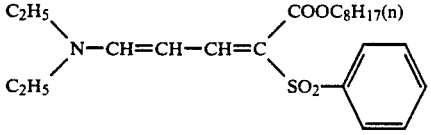

EX-1
-continued
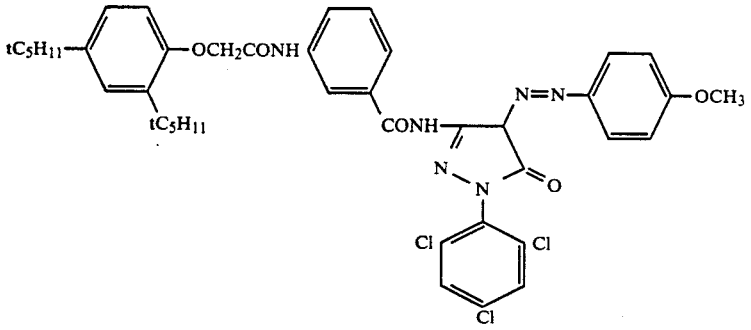
EX-2
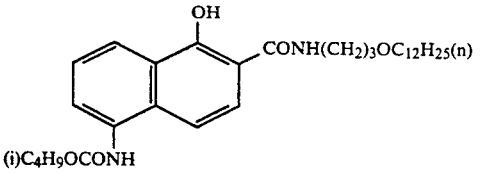
EX-3
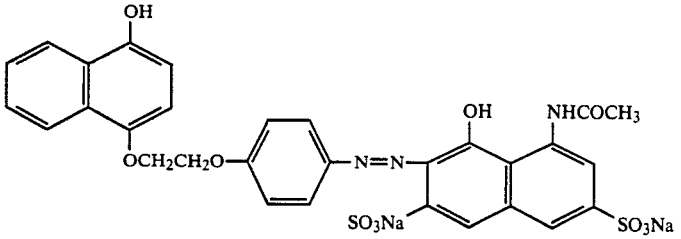
EX-4
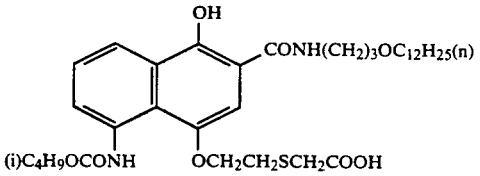
EX-5
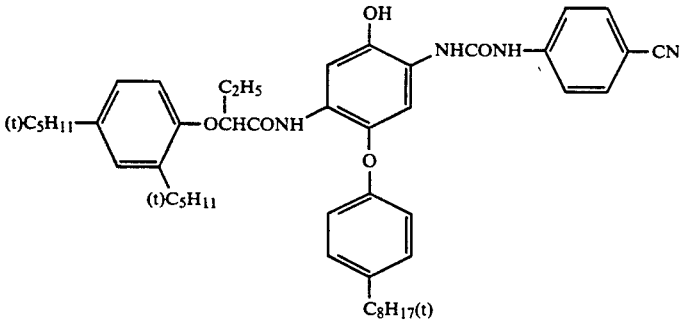

EX-6
-continued
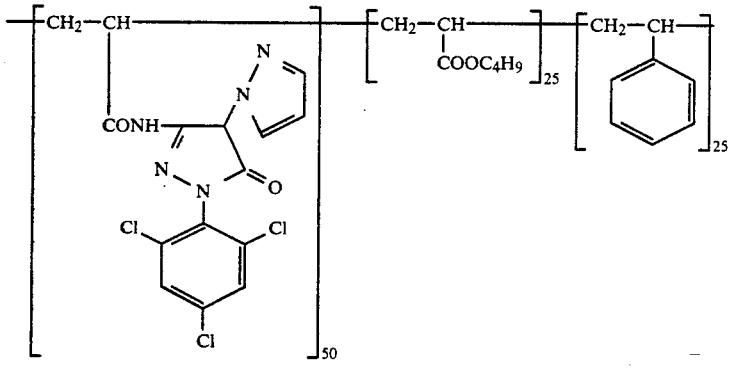
EX-7
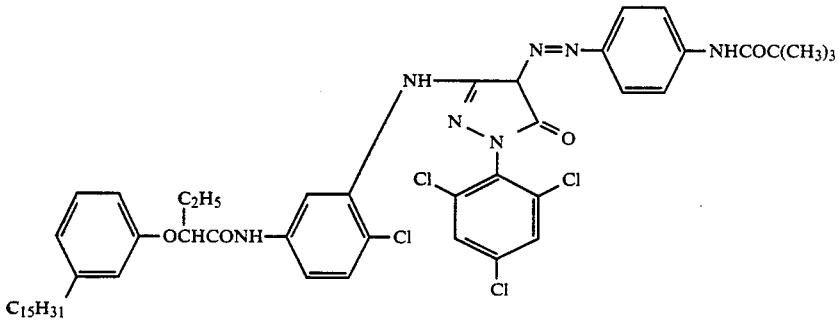
EX-8 (Compound (49) disclosed in U.S.Pat. No. 4,477,563)
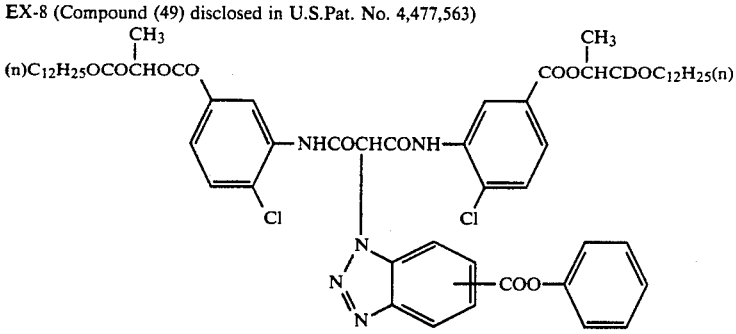
EX-9
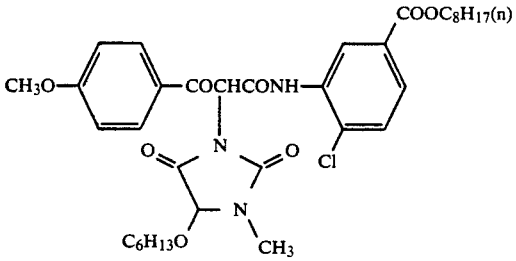
EX-10 (The compound disclosed in U.S. Pat. No. 4,477,563.)
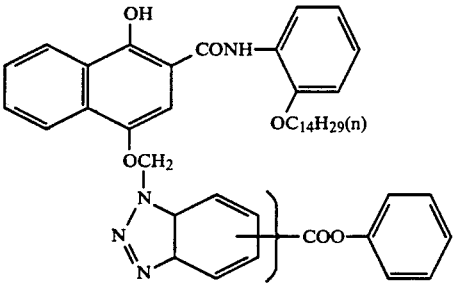

-continued
EX-11
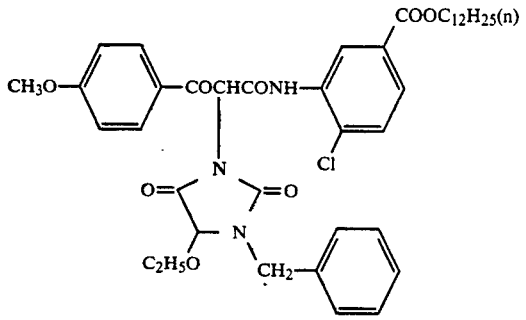
EX-12 (The coupler disclosed in U.S. Pat. No. 3,227,554.)
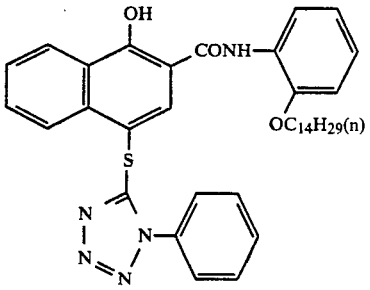
EX-13
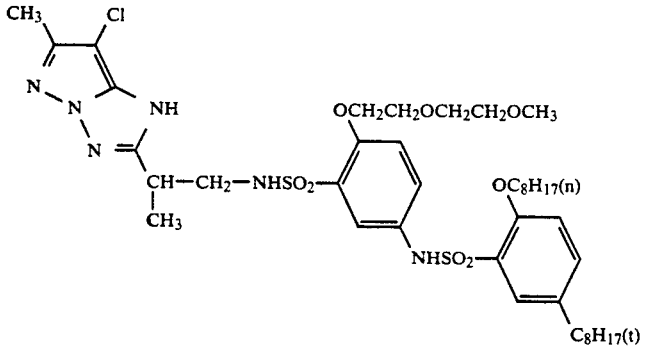
EX-14
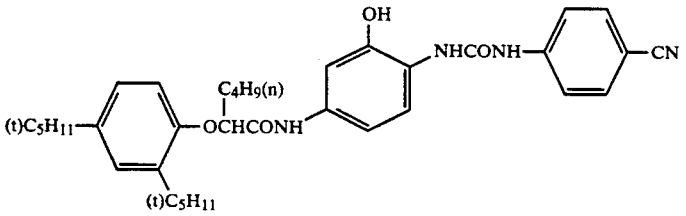
EX-15
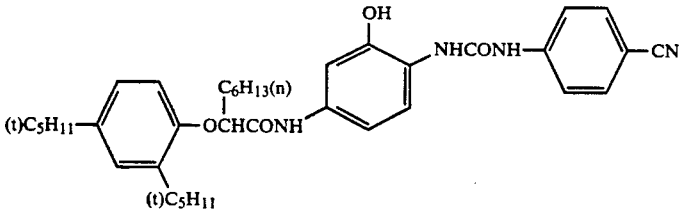

EX-16
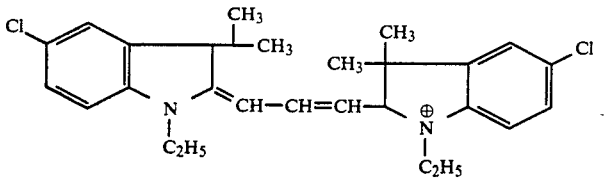
-continued
S-1
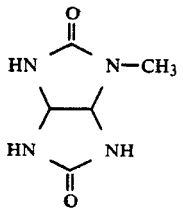
S-2
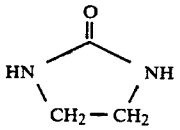
HBS-1: Tricresyl phosphate;
HBS-2: Dibutyl phtharate;
HBS-3: Bis(2-ethylhexyl)-phtharate;
HBS-4
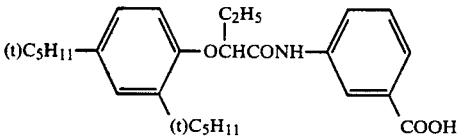
H-1
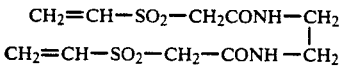
Sensitizing Dye I:
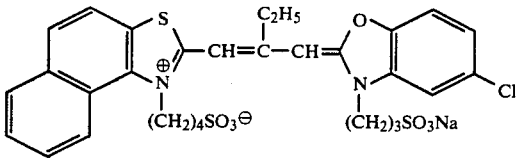
Sensitizing Dye II:
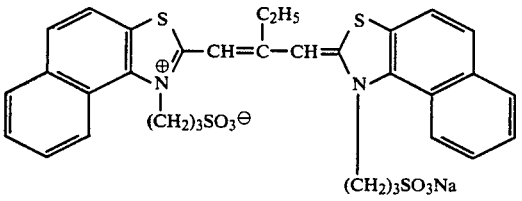
Sensitizing Dye III:
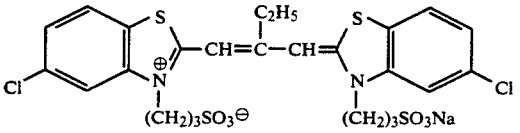

Sensitizing Dye IV:

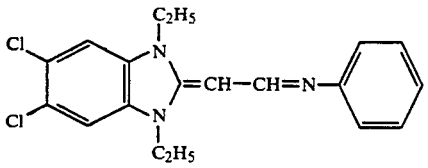

Sensitizing Dye V:

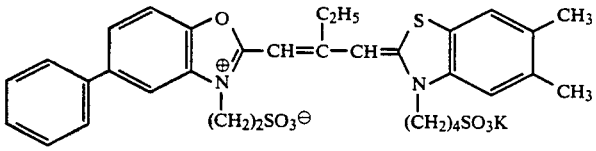

Sensitizing Dye IX:

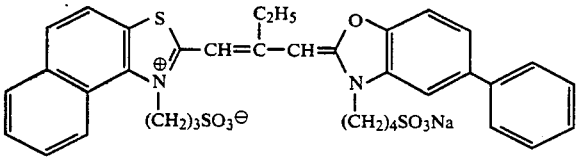

A-1: The compound (6) disclosed in U.S. Pat. No. 2,336,327.

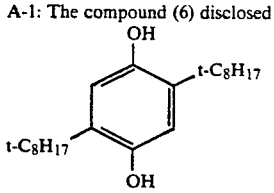

What is claimed is:

1. A method for processing a silver halide color photographic photosensitive material which comprises treating a silver halide photographic photosensitive material with a bath having fixing ability and then water washing and/or stabilizing the photosensitive material, wherein the amount of replenished liquid for water washing or stabilization is 1 to 50 times the volume of liquid carried over by the photosensitive material from the bath preceding the water washing bath or the stabilization bath and that the silver halide color photographic photosensitive material comprises at least one member selected from the group consisting of compounds represented by the following general formula (A) and alkaline unstable precursors thereof:

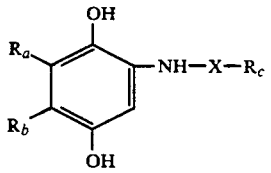

(A)

in the general formula (A), $R_a$ and $R_b$ each represents hydrogen atom, halogen atom, sulfo group, carboxyl group, alkyl group, acylamino group, alkoxy group, aryloxy group, alkylthio group, arylthio group, sulfonyl group, acyl group, carbamoyl group or sulfamoyl group with the proviso that $R_a$ and $R_b$ may form a carbon ring together with the carbon atoms to which they are bonded; X represents —CO—; and $R_c$ represents alkyl group, aryl group, heterocyclic group, cycloalkyl group, alkoxy group, aryloxy group or amino group; provided that the total number of carbon atoms of $R_a$, $R_b$ and $R_c$ is 10 or more and that the compound represented by the general formula (A) is substantially colorless and does not cause a coupling reaction with a developing agent to form a dye image.

2. A method according to claim 1 wherein the amount of the replenished liquid for water washing or stabilization is 3 to 30 times the volume of liquid carried over by the photosensitive material from the bath preceding the water washing bath or the stabilization bath.

3. A method according to claim 1 wherein the $R_a$ and $R_b$ in the general formula (A) each represents a hydrogen atom, halogen atom, alkyl group, alkoxy group or alkylthio group.

4. A method according to claim 1 wherein the $R_c$ represents an alkyl group or an aryl group which is unsubstituted or substituted with at least the substituent.

5. A method according to claim 4 wherein the substituent of the aryl group is selected from the group consisting of halogen atom, alkyl group, amido group, sulfoneamido group, alkoxy group, alkoxycarbonyl group and carbamoyl group.

6. A method according to claim 1 wherein the alkaline unstable precursors of the compounds represented by the general formula (A) are those represented by the general formula (A) in which the hydroxyl moiety located at 1- and 4-positions of the hydroquinone skeleton thereof is protected with protective groups capable of being eliminated under an alkaline condition.

7. A method according to claim 1 wherein the water washing or the stabilization step is conducted by using 2 or more baths and the replenishment of the washing water or the stabilization liquid is multistage countercurrent system.

8. A method according to claim 1 wherein the concentration of calcium and magnesium compounds contained in the washing water or the stabilization liquid is reduced to not more than 5 mg/l on the basis of calcium and magnesium.

9. A method according to claim 1 wherein the water washing or the stabilization time is 2 minutes or less.

10. A method according to claim 1 wherein the bath having a fixing ability is a bleaching-fixing bath.

11. A method according to claim 1 wherein the water or the stabilizing solution is continuously replenished into the water washing bath or the stabilization bath during processing.

12. A method according to claim 1 wherein the water or the stabilization solution is intermittently replenished into the water washing bath or the stabilization bath during processing.

13. A method according to claim 12 wherein the washing water or the stabilization solution is added to the water washing bath or the stabilization bath at intervals of about 1 $m^2$ or less of the photosensitive material processed.

14. A method according to claim 13 wherein the washing water or the stabilization solution is added to the water washing bath or the stabilization solution at intervals of 0.001 to 0.5 $m^2$ of the photosensitive material processed.

15. A method according to claim 1 wherein the washing water or the stabilization solution is replenished after the completion of the process.

16. A method according to claim 1 wherein each of Ra and Rb represents a hydrogen atom, an alkyl group or a halogen atom.

17. A method according to claim 1 wherein each of Ra and Rb represents a hydrogen atom.

18. A method according to claim 1 wherein Rc represents an aryl group.

* * * * *